US010508874B2

(12) United States Patent
Headrick et al.

(10) Patent No.: US 10,508,874 B2
(45) Date of Patent: Dec. 17, 2019

(54) AUTOMATIC SPENT MAGAZINE EJECTION AND CONTROL GROUP

(71) Applicant: 95790087 Canada Inc., North York (CA)

(72) Inventors: David Arthur Headrick, North York (CA); Leonel Henriques Machado, Beaverton (CA)

(73) Assignee: 9579087 Canada Inc., North York, Ontario (CA)

( * ) Notice: Subject to any disclaimer, the term of this patent is extended or adjusted under 35 U.S.C. 154(b) by 86 days.

(21) Appl. No.: 15/574,764

(22) PCT Filed: May 16, 2016

(86) PCT No.: PCT/IB2016/052810

§ 371 (c)(1),
(2) Date: Mar. 2, 2018

(87) PCT Pub. No.: WO2016/193841

PCT Pub. Date: Dec. 8, 2016

(65) Prior Publication Data

US 2018/0149438 A1 May 31, 2018

Related U.S. Application Data

(60) Provisional application No. 62/168,714, filed on May 29, 2015.

(51) Int. Cl.
*F41A 9/59* (2006.01)
*F41A 9/65* (2006.01)
(Continued)

(52) U.S. Cl.
CPC ..... *F41A 9/59* (2013.01); *F41A 3/72* (2013.01); *F41A 9/65* (2013.01); *F41A 17/36* (2013.01); *F41A 17/38* (2013.01); *F41A 35/06* (2013.01)

(58) Field of Classification Search
CPC ..... F41A 9/65; F41A 9/64; F41A 9/72
(Continued)

(56) References Cited

U.S. PATENT DOCUMENTS 1,368,719 A 2/1921 Hammond
4,664,015 A 5/1987 Kennedy
(Continued)

OTHER PUBLICATIONS

Byczko, Rafal "International Search Report", International Patent Application No. PCT/IB2016/052810, dated Aug. 11, 2016, 3 pages.

(Continued)

*Primary Examiner* — Samir Abdosh

(57) ABSTRACT

A firearm comprising: (i) an ammunition magazine which automatically ejects from the lower receiver of the firearm when the ammunition magazine is spent; (ii) a control group comprising a magazine release mechanism for releasing the magazine catch so that the ammunition magazine is detachable from the lower receiver, a bolt catch engage mechanism for engaging the bolt catch with the bolt carrier and retaining the bolt carrier in the retracted position, and a bolt catch release mechanism for releasing the bolt catch from the bolt carrier and allowing the bolt carrier to move forward, wherein the control group components can be operated by the user on either the left side or right side of the firearm; and (iii) optionally, a charging handle which can be operated by the user on either the left side or right side of the firearm.

5 Claims, 18 Drawing Sheets

(51) Int. Cl.

| | |
|---|---|
| ***F41A 17/36*** | (2006.01) |
| ***F41A 17/38*** | (2006.01) |
| ***F41A 3/72*** | (2006.01) |
| ***F41A 35/06*** | (2006.01) |

(58) Field of Classification Search
USPC ..... 42/49.01–50
See application file for complete search history.

(56) References Cited

U.S. PATENT DOCUMENTS 5,519,954 A 5/1996 Garrett
5,566,487 A 10/1996 Vaid et al.
5,588,241 A * 12/1996 Hurley ..... F41A 9/65 42/18
10,168,116 B1 * 1/2019 Jen ..... F41A 9/67
2010/0281737 A1 * 11/2010 Cahill ..... F41A 9/65 42/50
2013/0167421 A1 * 7/2013 Zheng ..... F41A 9/70 42/50
2014/0223791 A1 * 8/2014 Ruby ..... F41C 27/00 42/49.01
2015/0121736 A1 * 5/2015 Faifer ..... F41A 9/65 42/49.01
2018/0149438 A1 * 5/2018 Headrick ..... F41A 9/59

OTHER PUBLICATIONS

Byczko, Rafal , "Written Opinion", International Patent Application No. PCT/IB2016/052810, dated Aug. 11, 2016, 5 pages.

* cited by examiner

70

A
B
C 72
66

Fig 17a
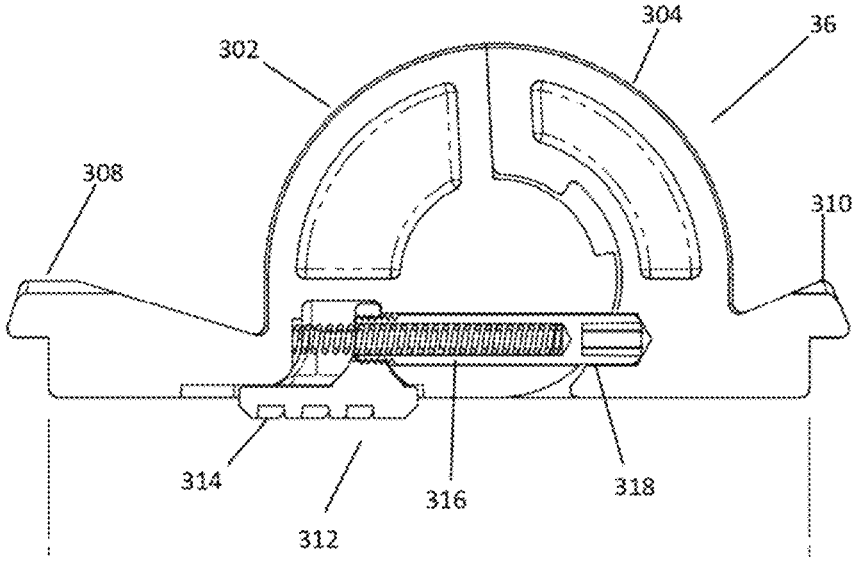
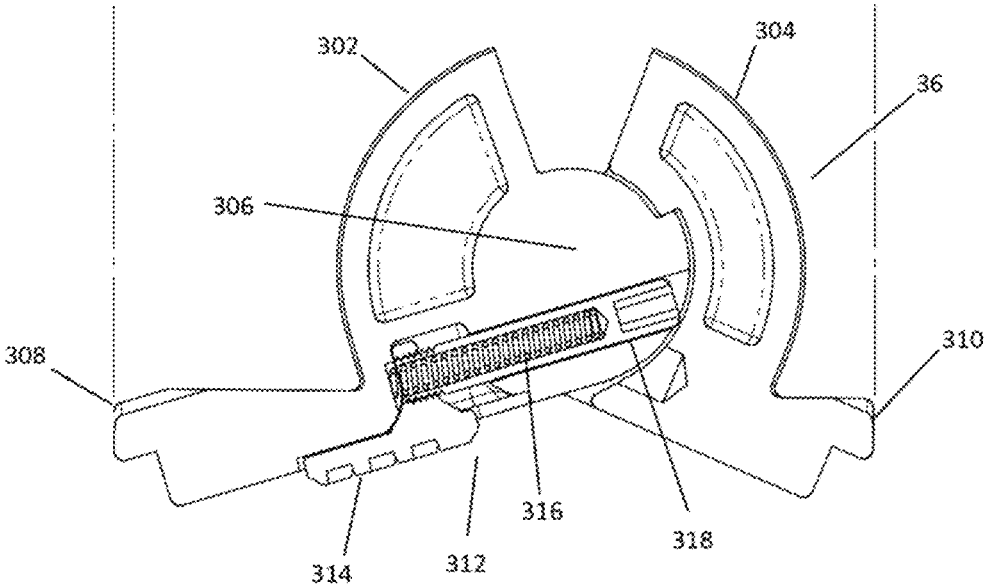
Fig 17b

AUTOMATIC SPENT MAGAZINE EJECTION AND CONTROL GROUP

CROSS REFERENCING OF RELATED APPLICATIONS

This application claims priority to and is a national phase under 37 CFR 1.371 of International Patent Application No. PCT/IB16/052810, filed on May 16, 2016, entitled "Automatic Spent Magazine Ejection & Control Group", which claims priority to U.S. Patent Application No. 62/168,714, filed on May 29, 2015, entitled "Automatic Spent Magazine Ejection & Control Group" and, both of which are incorporated by reference herein in their entirety.

FIELD OF THE INVENTION

The present invention relates to firearms, and more particularly, to firearms that operate using ammunition magazines and bolt systems.

BACKGROUND

Firearms are commonly used in industries such as the military, law enforcement, security, hunting and recreational target shooting. Many of today's firearms operate through the coordinated actions of an ammunition magazine and a bolt carrier.

Ammunition magazines store and feed multiple cartridges of ammunition while within or attached to a firearm. Ammunition magazines are generally made of metal or plastic, and they may be straight or curved. Magazines carry multiple cartridges of ammunition and allow the user to carry around the magazines themselves instead of loose cartridges. Perhaps the most common type of magazine today is the detachable box type. The detachable box type magazine has several benefits, including allowing the user to conveniently remove spent magazines and replace them with loaded magazines.

The detachable box type magazine comprises a container for storing ammunition. The container has a bottom end and an open top end, where the top end attaches to the firearm via a slot in the firearm's lower receiver. A spring-loaded follower for feeding ammunition cartridges is provided in the interior of the container. When ammunition is loaded into the magazine, it compresses the spring and pushes the follower downwards towards the bottom end. Cartridges may be stored in a column, usually with one above the other or staggered in a zig zag fashion. As the top cartridge is expended, the spring pushes the follower, as well as the ammunition on top of the follower, upwards towards the open top end of the magazine. The next cartridge is thus positioned to be loaded into the firearm's chamber.

In many firearms, when a new cartridge is pushed upwards to the top end of the magazine, a tubular bolt carrier is used to drive the cartridge forward into the chamber. A recess in the bolt face of the bolt carrier grips the back end of the cartridge. When the bullet is fired, it is expelled from the cartridge and rides down and out the barrel of the firearm. An empty cartridge case is left behind and held by the bolt face. Pressure, such as gas pressure from the firing of the bullet, causes the bolt carrier to move backwards taking the empty cartridge case with it. The empty cartridge case may be ejected out a port opening in the firearm or manually removed.

When the magazine is empty, a bolt catch is often used to retain the bolt carrier in a rearward position and prevents it from engaging the chamber. This allows the user to remove the spent magazine and replace it with a loaded magazine.

Unfortunately, the process of replacing an empty magazine with a loaded magazine requires multiple steps and is time consuming. Generally, the following steps are required:

Visually check that the magazine is out of ammunition and that the firearm has not jammed;

Remove empty magazine from the lower receiver of the firearm;

Insert loaded magazine into the lower receiver of the firearm;

Cycle the bolt carrier to chamber the first round of ammunition; and

Re-acquire the intended target for engagement.

In the many different critical and dangerous situations which can be faced by users in the military, law enforcement, security and even hunting, time is limited. Users must replace the empty magazine as quickly and efficiently as possible. Any features in the firearm that can automate, streamline, speed up or simplify any of these steps involved in reloading the firearm would be advantageous.

Most firearms have control features whereby a user can manually: (i) eject a magazine; (ii) release the bolt catch to allow the bolt carrier to move forward; and/or (iii) engage the bolt catch to retain the bolt carrier in the rearward position. Known firearms including the AR-15, M16 and M4 have such manual controls on only one side of the firearm. For example, many standard embodiments have the manual magazine release control on the right side only and the manual bolt catch controls on the left side only.

Many firearms also have a charging handle. This may be a protrusion or hook formed from the side of the bolt carrier or a lever. A charging handle allows the user to manually pull the bolt carrier rearwards. For example, the charging handle may be used to eject an empty cartridge case or unfired cartridge from the chamber, to load a round from the magazine, to clear a jam or double feed or to release the bolt carrier from being retained in the rearwards position. In cases where a jam occurs which requires clearing or the firearm needs to be cleaned or inspected, the bolt carrier needs to be moved rearwards and the charging handle is used to accomplish this.

Charging handles often protrude out one side of the firearm and are therefore, susceptible to getting caught on objects and getting damaged. Furthermore, many charging handles are not sufficiently large or easy to grip by users, such as users who are wearing gloves or protective clothing. Also charging handles are only generally operable from one side of the firearm.

Most users are not ambidextrous and therefore, will generally find it more difficult to operate a control present on only one of the two sides of the firearm. Alternatively, in critical and dangerous situations which can be faced by a user, the user's access to one side of the firearm may be obstructed or hampered. For example, one of the user's hands or arms may be physically injured and have difficulty accessing one side of the firearm. In addition, in a critical and dangerous situation, it may be important for the user's self defence to keep a finger of his or her preferred hand on the trigger while operating the firearm's various controls with his or her opposing hand. Therefore, a firearm which provides for ambidextrous operation of its controls would be beneficial.

Bolt catch release levers are available which extend around the outside of the lower receiver from one side to the other side. This allows the user to release the bolt catch manually from either side of the firearm. Typically, these pass through the trigger area and can interfere with gloved operation. Unfortunately, such a device which extends around the exterior of the firearm is susceptible to damage, getting caught on other objects and so on. Other solutions which provide for user control on both sides of the firearm require a modified lower receiver to be compatible. This is not only costly and complex to do, but also undesirable because the lower receiver is often the registered part of the firearm and is preferably not replaced.

It would be beneficial to have features on the firearm that allow a user to quickly, conveniently and manually: (i) eject the magazine; (ii) release the bolt catch to allow the bolt carrier to move forward; (iii) engage the bolt catch to retain the bolt carrier in the rearward position; and/or (iv) operate the charging handle, on either side of the firearm.

SUMMARY OF THE INVENTION

In one aspect, the present invention provides a firearm having a forward end and a rearward end, and a left side and a right side opposite the left side, said firearm comprising an ammunition magazine for carrying ammunition cartridges, an upper receiver, a lower receiver, a magazine catch for attaching the ammunition magazine to the lower receiver, and a magazine release mechanism for releasing the magazine catch so that the ammunition magazine is detachable from the lower receiver, said firearm comprising a chamber, a bolt carrier for stripping an ammunition cartridge from the ammunition magazine and moving the ammunition cartridge forward to the chamber, a bolt catch for retaining the bolt carrier in a retracted position rearward from the ammunition magazine, a bolt catch engage mechanism for engaging the bolt catch with the bolt carrier and retaining the bolt carrier in the retracted position, and a bolt catch release mechanism for releasing the bolt catch from the bolt carrier and allowing the bolt carrier to move forward, said ammunition magazine comprising a container body for carrying ammunition cartridges, said container body having a bottom end defined by a bottom door, a side wall extending upwards from the bottom door, an open top end which is attachable to the lower receiver by the magazine catch, said ammunition magazine comprising a follower positioned inside the container body, and a follower spring positioned between the follower and the bottom door, wherein the follower spring provides force to bias the follower and the bottom door so that the follower moves up the side wall as ammunition cartridges are used, wherein said follower further comprises an outwardly extending protrusion, said protrusion making contact with and moving the magazine catch when the last ammunition cartridge has been stripped from the ammunition magazine and the follower has moved up above the open top end of the ammunition magazine, such that the ammunition magazine is detachable from the lower receiver, said magazine release mechanism comprising a left magazine release feature on the left side of the firearm and a right magazine release feature on the right side of the firearm, wherein the magazine release mechanism is configured so that the left magazine release feature is actuated with a first user action to release the magazine catch and detach the ammunition magazine from the lower receiver, and wherein the magazine release mechanism is configured so that the right magazine release feature is actuated with a second user action to release the magazine catch and detach the ammunition magazine from the lower receiver, said bolt catch engage mechanism comprising a left bolt catch engage feature on the left side of the firearm and a right bolt catch engage feature on the right side of the firearm, wherein the bolt catch engage mechanism is configured so that the left bolt catch engage feature is actuated with a third user action to engage the bolt catch with the bolt carrier and retain the bolt carrier in the retracted position, and wherein the bolt catch engage mechanism is configured so that the right bolt catch engage feature is actuated with a fourth user action to engage the bolt catch with the bolt carrier and retain the bolt carrier in the retracted position, said bolt catch release mechanism comprising a left bolt catch release feature on the left side of the firearm and a right bolt catch release feature on the right side of the firearm, wherein the bolt catch release mechanism is configured so that the left bolt catch release feature is actuated with a fifth user action to release the bolt catch from the bolt carrier and allow the bolt carrier to move forward, and wherein the bolt catch release mechanism is configured so that the right bolt catch release feature is actuated with a sixth user action to release the bolt catch from the bolt carrier and allow the bolt carrier to move forward.

In another aspect, the present invention provides an ammunition magazine for use with a firearm, said firearm comprising a lower receiver and a magazine catch for attaching the ammunition magazine to the lower receiver, said ammunition magazine comprising a container body for carrying ammunition cartridges, said container body having a bottom end defined by a bottom door, a side wall extending upwards from the bottom door, an open top end which is attachable to the lower receiver by the magazine catch, said ammunition magazine comprising a follower positioned inside the container body, and a follower spring positioned between the follower and the bottom door, wherein the follower spring provides force to bias the follower and the bottom door so that the follower moves up the side wall as ammunition cartridges are used, wherein said follower further comprises an outwardly extending protrusion, said protrusion making contact with and moving the magazine catch when the last ammunition cartridge has been stripped from the ammunition magazine and the follower has moved up above the open top end of the ammunition magazine, such that the ammunition magazine is detachable from the lower receiver.

In another aspect, the present invention provides a control group for a firearm, said firearm having a forward end and a rearward end, and a left side and a right side opposite the left side, said firearm comprising an ammunition magazine for carrying ammunition cartridges, a lower receiver and a magazine catch for attaching the ammunition magazine to the lower receiver, said firearm comprising a chamber, a bolt carrier for stripping an ammunition cartridge from the ammunition magazine and moving the ammunition cartridge forward to the chamber, a bolt catch for retaining the bolt carrier in a retracted position rearward from the ammunition magazine, said control group comprising a magazine release mechanism for releasing the magazine catch so that the ammunition magazine is detachable from the lower receiver, a bolt catch engage mechanism for engaging the bolt catch with the bolt carrier and retaining the bolt carrier in the retracted position, and a bolt catch release mechanism for releasing the bolt catch from the bolt carrier and allowing the bolt carrier to move forward, said magazine release mechanism comprising a left magazine release feature on the left side of the firearm and a right magazine release feature on the right side of the firearm, wherein the magazine release mechanism is configured so that the left magazine release feature is actuated with a first user action to release the magazine catch and detach the ammunition magazine from the lower receiver, and wherein the magazine release mechanism is configured so that the right magazine release feature is actuated with a second user action to release the magazine catch and detach the ammunition magazine from the lower receiver, said bolt catch engage mechanism comprising a left bolt catch engage feature on the left side of the firearm and a right bolt catch engage feature on the right side of the firearm, wherein the bolt catch engage mechanism is configured so that the left bolt catch engage feature is actuated with a third user action to engage the bolt catch with the bolt carrier and retain the bolt carrier in the retracted position, and wherein the bolt catch engage mechanism is configured so that the right bolt catch engage feature is actuated with a fourth user action to engage the bolt catch with the bolt carrier and retain the bolt carrier in the retracted position, said bolt catch release mechanism comprising a left bolt catch release feature on the left side of the firearm and a right bolt catch release feature on the right side of the firearm, wherein the bolt catch release mechanism is configured so that the left bolt catch release feature is actuated with a fifth user action to release the bolt catch from the bolt carrier and allow the bolt carrier to move forward, and wherein the bolt catch release mechanism is configured so that the right bolt catch release feature is actuated with a sixth user action to release the bolt catch from the bolt carrier and allow the bolt carrier to move forward.

In another aspect, the present invention provides a charging handle for use with a firearm, said firearm having a forward end and a rearward end, and a left side and a right side opposite the left side, said firearm comprising an upper receiver, a chamber, a bolt carrier for stripping an ammunition cartridge from an ammunition magazine and moving the ammunition cartridge forward to the chamber, said charging handle configured to be secured to the upper receiver of the firearm, said charging handle comprising a front end and a rear end, and a shaft extending from the front end to the rear end, said charging handle further comprising a hook at the front end, wherein said hook engages the bolt carrier of the firearm, said charging handle further comprising a first grip wing and a second grip wing adjacent the rear end, wherein when the charging handle is in use, the first grip wing extends outwards in a direction generally perpendicular to the left side of the firearm and the second grip wing extends outwards in a direction generally perpendicular to the right side of the firearm, wherein when the charging handle is in use, the user grasps and pulls on one or both of the left grip wing and the right grip wing with a rearwards force, causing the charging handle to move rearwards and causing the bolt carrier to move rearwards, wherein when the charging handle is not in use, the first grip wing folds inwards and extends in a direction generally parallel to the left side of the firearm and the second grip wing folds inwards and extends in a direction generally parallel to the right side of the firearm.

The firearm of the present invention is designed to increase the speed of deployment of the firearm, particularly in reloading the weapon. Furthermore, the firearm of the present invention is designed to allow easy access to the control functions thereof, particularly on both sides of the firearm.

Upon the last cartridge being chambered, the ammunition magazine of the present invention is automatically ejected, thus saving critical seconds that the user would otherwise need to spend checking to see if the magazine is out of ammunition and manually removing the magazine. The user need not spend time reacquiring the target and is protected by the chambered round of ammunition.

The ammunition magazine may be ejected in any orientation and at any angle. This feature may be critical as the user may be in a dangerous situation where he or she needs to hold the firearm in an awkward or unorthodox position, such as upside down or sideways.

In addition, the automatic ejection of the spent ammunition magazine prevents accidental or mistaken loading of empty ammunition magazines. There is also a reduction in double-feeding jams.

The control group of components of the firearm of the present invention, including the magazine release mechanism, the bolt catch engage mechanism and the bolt catch release mechanism, can be easily retrofitted onto the standard lower receivers of many firearms, including all US military standard MIL-SPEC lower receivers, without any need for machining or alterations. No modification to the lower receiver or any other part of the firearm is required other than a substitution of parts. Installation of the control group is simple and efficient, and does not require any specialized tools or jigs.

This control group has a slick, non-obtrusive profile. Since the control group does not protrude out either side of the firearm or extend around the exterior of the firearm, it is not susceptible to getting caught on other objects or being damaged.

The control group of the present invention may be used with standard ammunition magazines. It is preferably used in conjunction with the ammunition magazine of the present invention, as this provides the additional functionality of automatic ejection of empty magazines.

The charging handle of the present invention is less susceptible to getting caught on objects, such clothing or straps, and to getting damaged because the grip wings are folded inwards when the charging handle is not in use.

The charging handle of the present invention is easy and comfortable to use because the grip wings are large enough to allow for access by two to three fingers, instead of only one. Also, the grip wings can extend out both sides of the firearm and therefore, allow for ambidextrous operation.

The control group and the charging handle of the present invention can be operated from either the left side or right side of the firearm. This may be crucial in a situation where the user needs to or prefers to operate one of the firearm's controls with his or her left hand or right hand only. For example, one of the user's hands may be injured leaving only the other hand to operate the controls. Alternatively, the user may be in a situation where he or she needs to defend himself or herself by keeping the finger of his or her preferred hand on the trigger while operating the controls with the opposing hand. The firearm of the present invention provides for such ambidextrous operation.

DESCRIPTION OF THE DRAWINGS

FIG. 16*a* shows the magazine release activated from the left side of the firearm, FIG. 16*b* shows the magazine release in its un-activated state, and FIG. 16*c* shows the magazine release activated from the right side of the firearm;

FIGS. 17*a* and 17*b* are section views of the bottom door of the preferred magazine, and specifically, FIG. 17*a* shows the bottom door in the installed and locked state, and FIG. 17*b* shows the bottom door unlocked and fully folded.

DETAILED DESCRIPTION OF THE PREFERRED EMBODIMENT

Figures 1A, 1B, 1C:
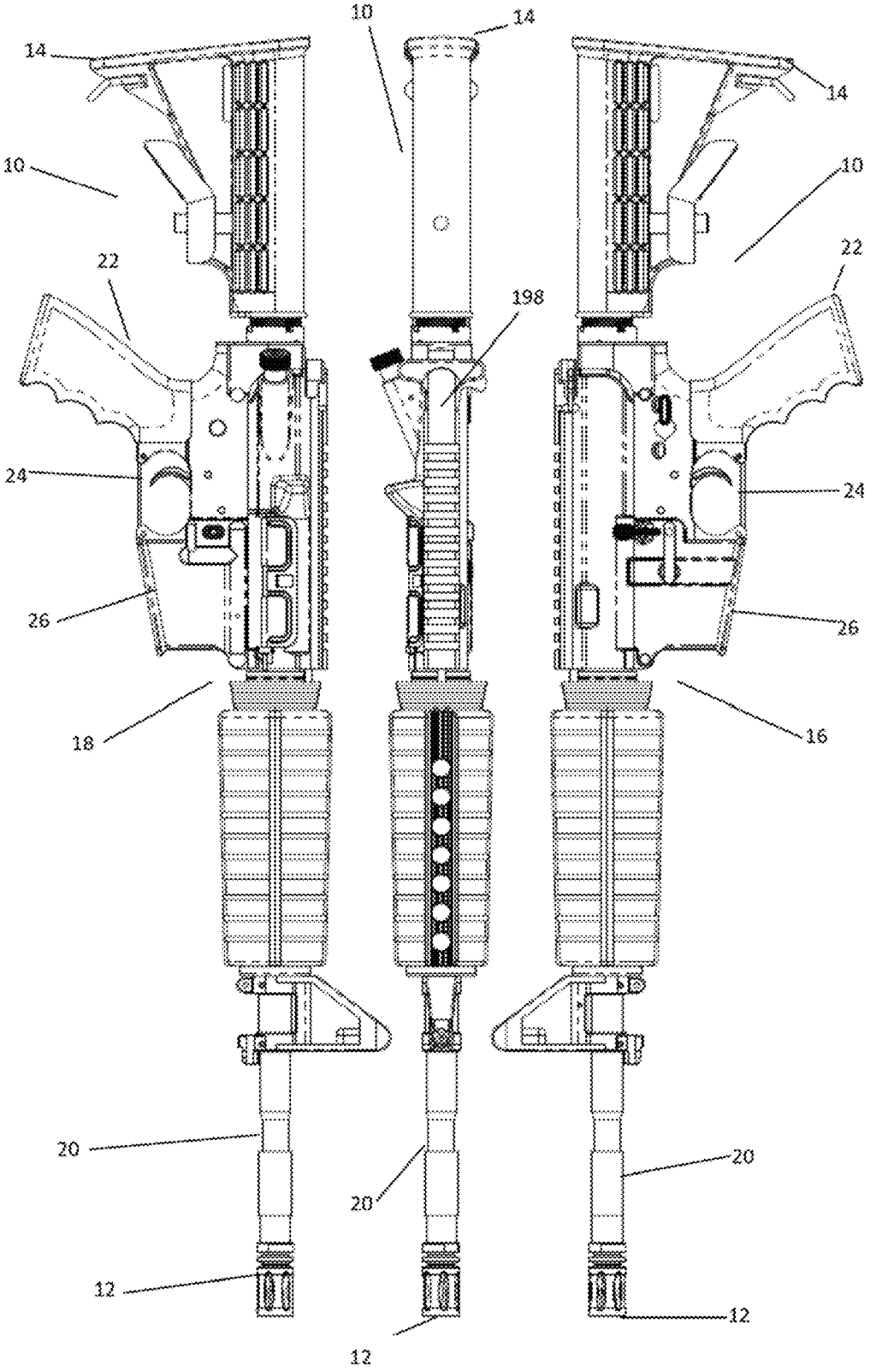
Fig 1a (Prior Art) Fig 1b (Prior Art) Fig 1c (Prior Art)
FIGS. 1*a*, 1*b* and 1*c* illustrate right, top and left views of a prior art AR-15 rifle.
Figures 2A, 2B, 2C:
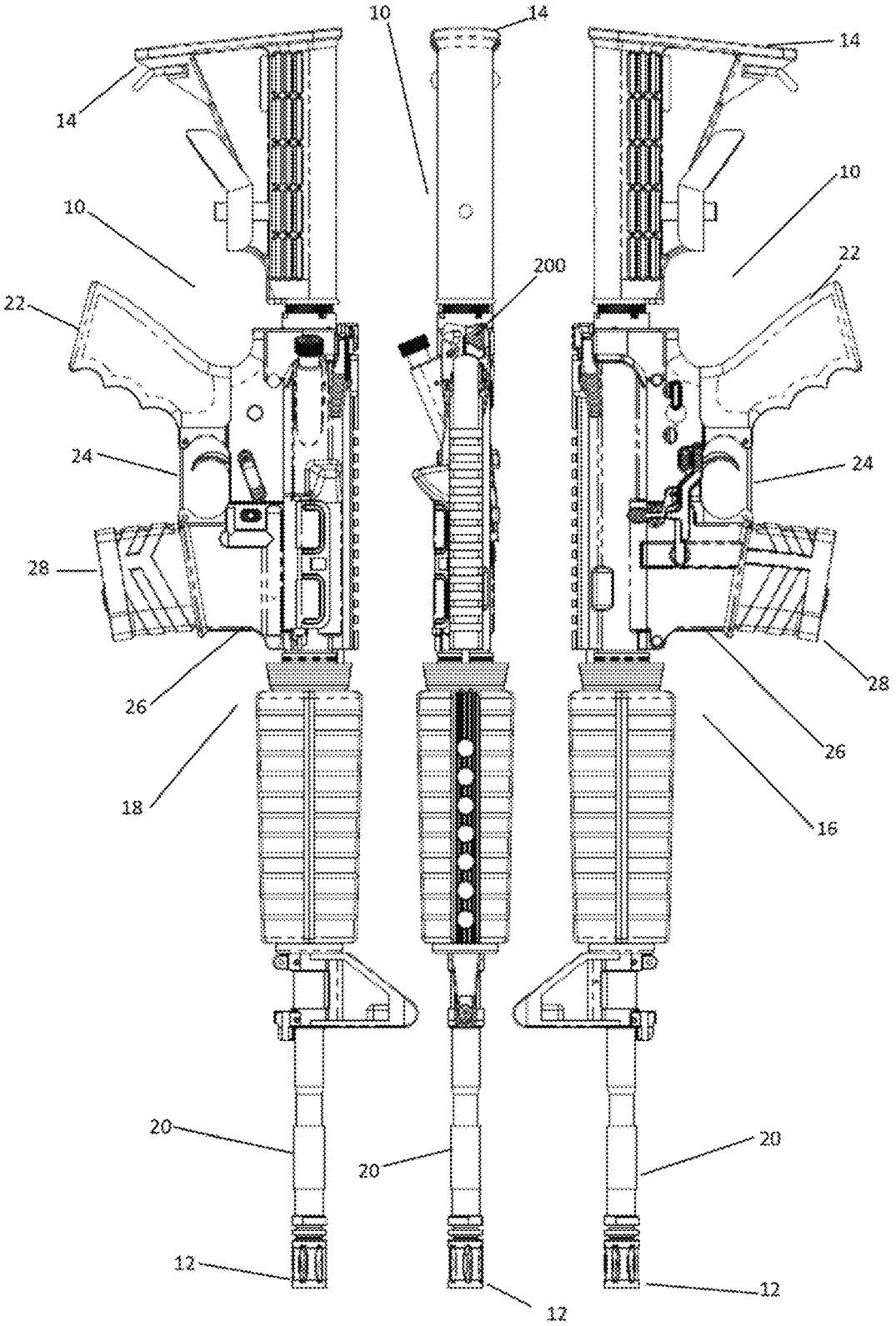
FIGS. 2*a*, 2*b* and 2*c* illustrate right, top and left views of a preferred embodiment of the firearm of the present invention, wherein the preferred embodiment is an AR-15 rifle.
Figure 3:
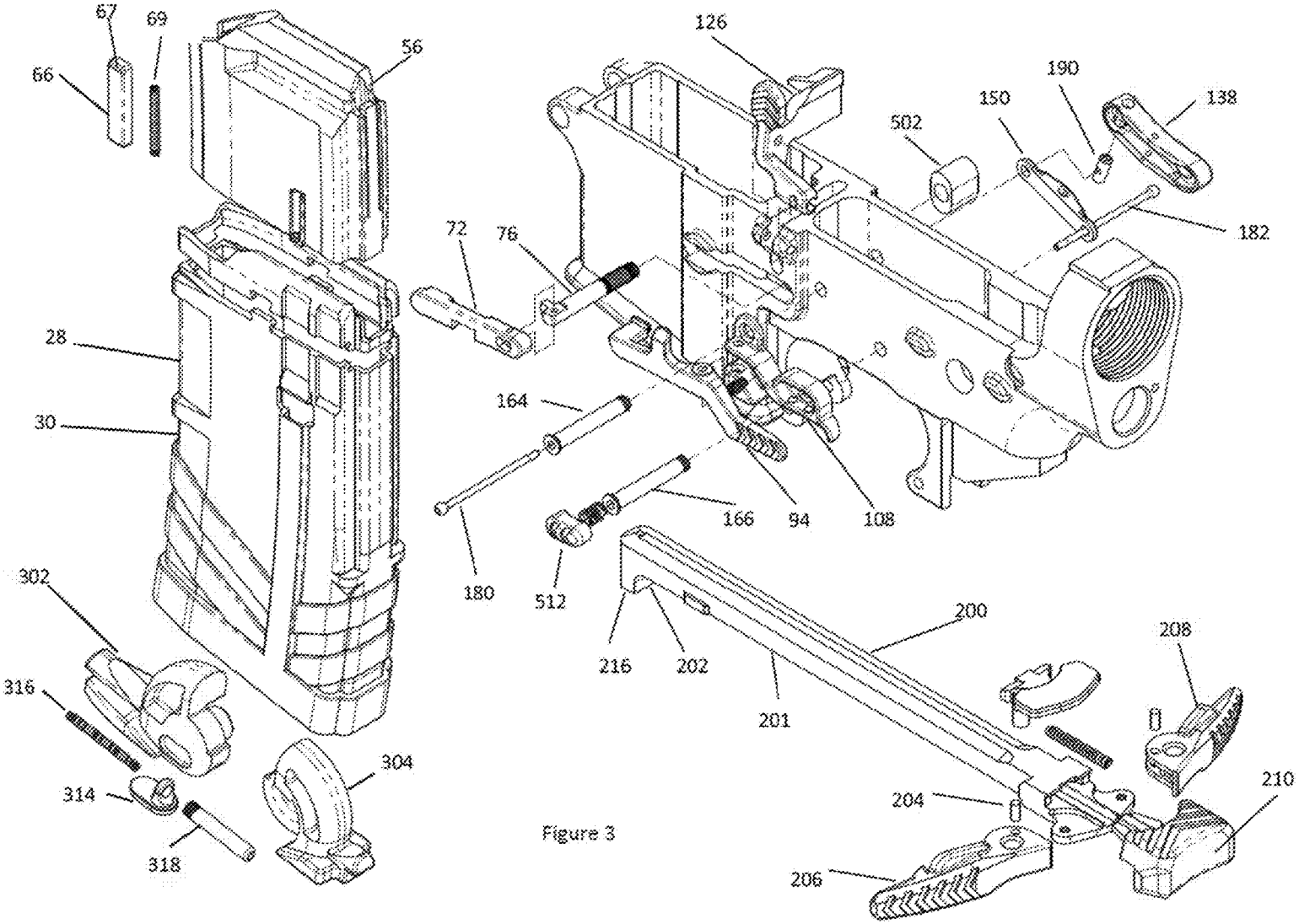
FIG. 3 is an exploded view of the components of a preferred embodiment of the present invention.

A preferred embodiment of the firearm 10 of the present invention is illustrated in FIGS. 2 to 5, and can be compared to the prior art AR-15 rifle shown in FIG. 1. Firearm 10 has a forward end 12 and a rearward end 14. The firearm 10 also has a left side 16 and a right side 18. The forward end 12 includes the barrel 20 from which a projectile, such as a bullet, is launched towards a target. The length and diameter of the barrel 20 varies widely depending on the type of firearm. The rearward end 14 includes a handle 22 onto which a user grips the firearm 10. A trigger 24 is present forward of the handle 22 and is squeezed rearwards by the user when the user desires to fire a bullet.

A lower receiver 26 is present between the barrel 20 and trigger 24, wherein the lower receiver 26 is the point of attachment for an ammunition magazine 28. FIGS. 6 to 9 illustrate a preferred embodiment of the ammunition magazine 28 of the present invention. The magazine 28 includes a container body 30 for storing ammunition cartridges 32. The bottom end 34 of the magazine 28 is defined by a bottom door 36. The top end 38 of the magazine 28 is open and attaches to the lower receiver 26. A side wall 40 extends from the bottom end 34 to the top end 38 and has a forward side 42, a rearward side 44, a left side 46 and a right side 48. The magazine 28 of the present invention is configured to interface with a standard lower receiver 26.

Retention flanges 50 preferably extend upwardly and inwardly from the upper parts of the side wall 40, preferably from one or both of the left side 46 and right side 48. The retention flanges 50 provide increased structural support in the container body 30, which makes ejection of the ammunition magazine 28 easier by preventing lateral bulges under load. The flanges 50 also provide retention of the cartridges 32 in the container body 30 such that only the top cartridge 32 can be stripped from the magazine 28 at one time. This prevents double feeding jams that are common in many standard ammunition magazines. The upper portion of the magazine 28 which includes the retention flanges 50 is preferably a separate component so that it can be made from a different material than the lower portion of the magazine 28.

Preferably, a channel 52 extends generally vertically along the side wall 40 on the same side as the magazine catch interface feature, either on the left side 46 or the right side 48. Depressed sections 54 are present in the side wall 40 adjacent the channel 52.

A follower 56 resides inside the container body 30 of the magazine 28. The follower 56 has a platform 58 upon which ammunition cartridges 32 can rest. A skirt 60 extends generally perpendicularly and downwardly from the platform 58. The skirt 60 is preferably continuous but may be split into separate sections. A follower spring 62 is provided between the follower 56 and the bottom door 36. When the magazine 28 has ammunition cartridges 32 loaded into it, the ammunition cartridges 32 push the follower 56 downwards towards the bottom end 34 and the spring 62 is compressed. In the preferred embodiment, the cartridges 32 are stored in a column, with one above the other. As the top cartridge 32 is stripped from the magazine 28, the spring 62 pushes the follower 56, as well as the lower cartridges 32 resting on top of the follower 56, upwards towards the open top end 38 of the magazine 28. The next cartridge 32 is thus positioned against the retention flanges 50 and can be stripped from the magazine 28.

The platform 58 of the follower 56 preferably has inwardly and upwardly curving shoulders 64. When the follower 56 is pushed upwards by the spring 62, the inwardly curving shoulders 64 pass in between and above the retention flanges 50.

A protrusion 66 extends outwardly from the skirt 60. As the follower 56 moves up and down the container body 30, the protrusion 66 moves up and down the channel 52 in the side wall 40. Depressions 68 are preferably formed in the skirt 60 on either side of the protrusion 66, and help to reduce friction of the movement of the follower 56 and allow dirt and debris to pass through.

In one preferred embodiment, the protrusion 66 is a separate part from the follower 56. The protrusion 66 preferably has an angled ramp 67 on its upper surface. Preferably, the protrusion 66 can move up and down relative to the skirt 60 of the follower 56. A spring 69 is present to bias the movement of the protrusion 66 upwards relative to the skirt 60 of the follower 56.

The rear side of the follower 56 preferably provides a flexible structure 70 for retention of the follower spring 62, such that the spring 62 can be installed and removed without the use of any tools.

Preferably, as shown in FIGS. 17*a* and 17*b*, the bottom door 36 of the magazine 28 comprises a front half section 302, a rear half section 304 and a hinge 306 located between the front half section 302 and the rear half section 304. The hinge 306 has a folding axis oriented substantially perpendicular to the left side 16 and the right side 18 of the firearm 10.

The bottom door 36 has tabs 308, 310 extending from each half section 302, 304. These tabs 308, 310 are configured to interface with cavities in the container body 30 of the magazine 28 when the front half section 302 and the rear half section 304 extend parallel to each other. The bottom door 36 preferably further comprises a sliding lock 312 which disables the hinge 306 when the front half section 302 and the rear half section 304 extend parallel to each other. The sliding lock 312 comprises a lock slide button 314, a spring 316 and a lock sleeve 318. In one preferred embodiment, the front half section 302 and the rear half section 304 interface with a lower end of the follower spring 62 for retaining the follower spring 62 in place.

A control group of the firearm of the present invention will now be described with respect to a preferred embodiment as shown in FIGS. 2 to 5, 10, 15 and 16. The control group comprises a magazine release mechanism, a bolt catch engage mechanism and a bolt catch release mechanism.

Figure 10:
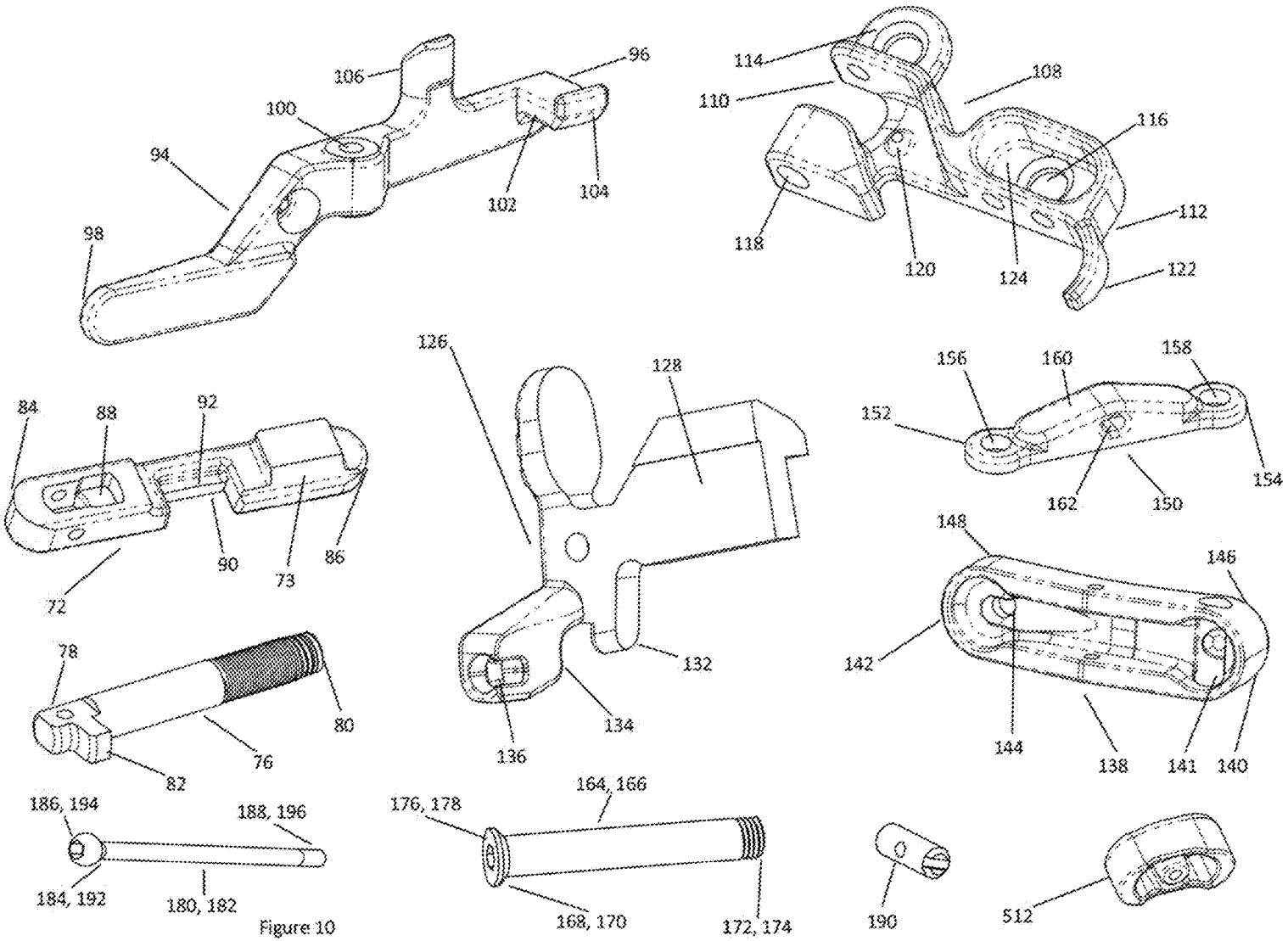
FIG. 10 is a view of the individual components of a preferred control group of the present invention.
Figure 11:
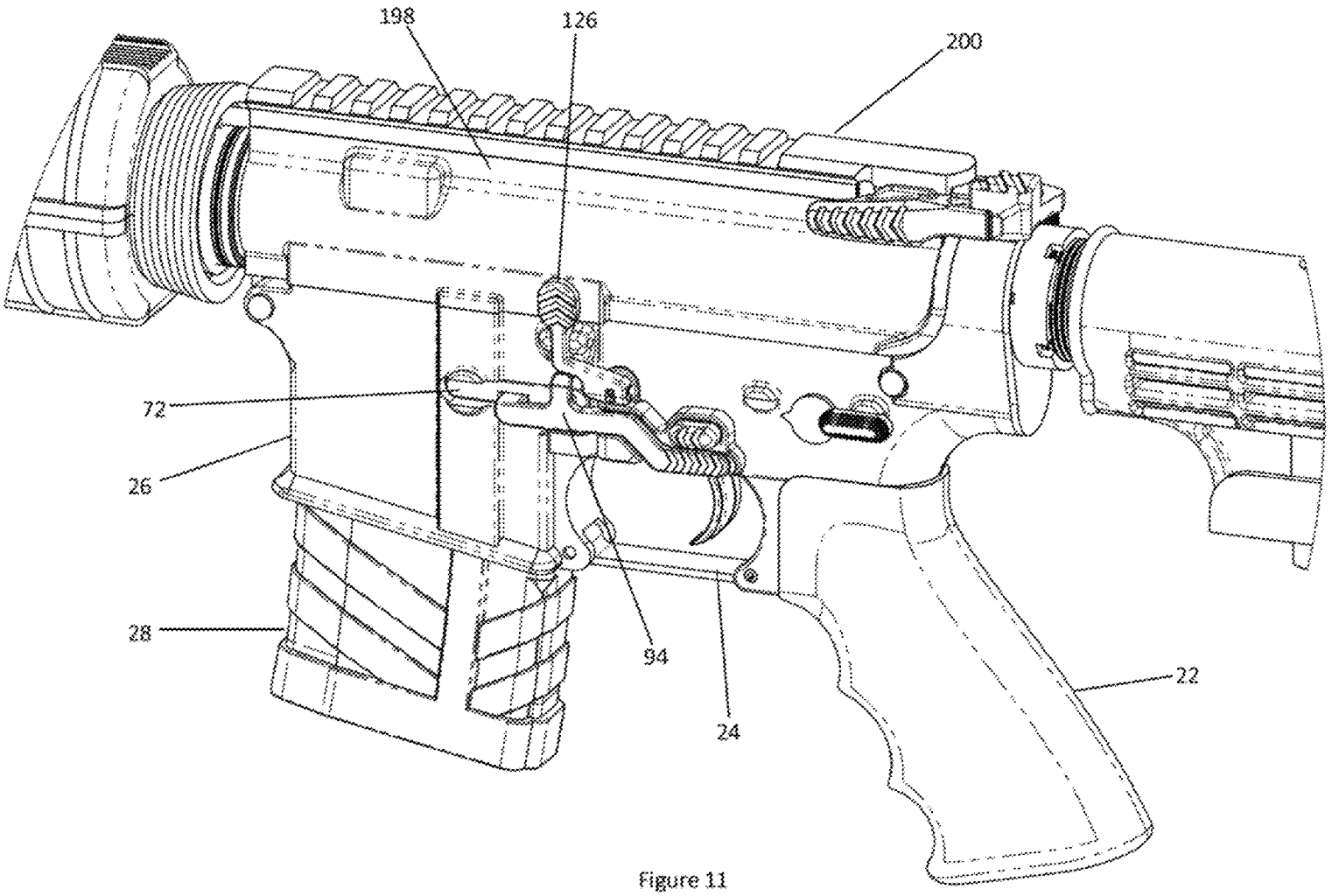
FIG. 11 is a plan view of a preferred charging handle of the present invention applied to the upper receiver of a firearm.

The top end 38 of the magazine 28 fits into a standard lower receiver 26 and is secured by a magazine release catch 72. The present invention preferably provides a magazine release mechanism, whereby when the ammunition cartridges 32 in the magazine 28 are spent, the magazine release mechanism operates to release the magazine release catch 72 and the empty magazine 28 is ejected from the lower receiver 26. The individual components of the preferred magazine release mechanism are shown in FIG. 10. A magazine release post 76 is a post with a proximal end 78 and a distal end 80. A protrusion 82 extends from the proximal end of the post. The magazine release catch 72 also has a proximal end 84 and a distal end 86. A cavity 88 is formed at the proximal end 84 of the magazine release catch 72. A notch 90 and an associated ledge 92 are formed between the proximal end 84 and the distal end 86 of the magazine release catch 72. The proximal end 78 of the magazine release post 76 fits into the cavity 88 at the proximal end 84 of the magazine release catch 72 so that the two components extend approximately perpendicular to each other. The magazine release post 76 and the magazine release catch 72 can pivot with respect to each other in only one direction, from being perpendicular to each other to an angle that is obtuse to each other. The pivoting action takes place around the central axis of the magazine release post 76. The magazine release mechanism can be activated either automatically when the magazine 28 is empty or manually by the user. When activated automatically (or manually from the left side), the magazine release mechanism acts as a class 2 lever with the fulcrum being located at the contact point between the magazine release catch 72 and the lower receiver 26.

Preferably, the lower surface of the magazine release catch 72 comprises an angled surface 73 which corresponds and interacts with the angled ramp 67 of the protrusion 66 on the follower 56.

A stack lever 94 allows manual control of the magazine release as well as automatic bolt catch engagement when no magazine is present and is shown in FIG. 10. The stack lever 94 has a proximal end 96 and a distal end 98. A pivot point 100 is located between the proximal end 96 and the distal end 98 of the stack lever 94. At the proximal end 96 of the stack lever 94, there is a first protrusion 102 extending therefrom and a hook 104 at the end of the first protrusion 102. The first protrusion 102 is configured to extend through the notch 90 of the magazine release catch 72 and rest on the depressed section 54 of the magazine 28. The hook 104 is configured to engage the ledge 92 of the magazine release catch 72. A second protrusion 106 is located between the proximal end 96 and the pivot point 100 of the stack lever 94 and extends generally upwardly. When activated, the stack lever 94 acts as a class 1 lever with the fulcrum being around its pivot point 100.

The stack lever 94 is mounted to the firearm 10 via a stack lever mount 108 which is shown in FIG. 10. The stack lever mount 108 has a proximal end 110 and a distal end 112. A first mounting hole 114 is formed adjacent to the proximal end 110, while a second mounting hole 116 is formed adjacent to the distal end 112. The first mounting hole 114 and second mounting hole 116 are arranged to match the standard pivots of the trigger group of a standard lower receiver. The stack lever mount 108 also has a pivot point 118 which aligns with the pivot point 100 of the stack lever 94. A spring 120 is trapped between the stack lever 94 and the stack lever mount 108 to bias the stack lever 94 to pivot inwards relative to the stack lever mount 108 at the pivot points 100, 118. A fence 122 is preferably located at the distal end 112 of the stack lever mount 108 and protects against accidental actuation of the stack lever 94. A walled cavity 124 is formed adjacent the distal end 112 and surrounds the second mounting hole 116.

In addition to working in conjunction with the magazine release mechanism, the stack lever 94 also works in conjunction with the bolt catch 126, which is shown in FIG. 10. The bolt catch 126 comprises a face 128 which, when the bolt catch 126 is engaged, is in a position to physically block the bolt carrier 130 from travelling forward. A first protrusion 132 of the bolt catch 126 interacts with the second protrusion 106 of the stack lever 94. A second protrusion 134 of the bolt catch 126 is provided and allows the user to manually control the bolt catch 126. Specifically, when the user applies force to the second protrusion 134, such as through a button or pad, the bolt catch 126 is engaged and blocks the forward motion of the bolt carrier 130. The bolt catch 126 also comprises a cavity 136 adjacent the second protrusion 134, wherein the cavity 136 is configured to receive a link rod.

A rocker lever 138 is provided on the side of the firearm 10 opposite to the stack lever 94. For example, if the stack lever 94 is on the left side 16, then the rocker lever 138 is on the right side 18. Conversely, if the stack lever 94 is on the right side 18, then the rocker lever 138 is on the left side 16. As shown in FIG. 10, the rocker lever 138 has a proximal end 140 and a distal end 142. The rocker lever 138 has a first cavity 141 formed therein configured to receive the barrel nut 190. The rocker lever 138 also has a second cavity 144 formed therein which is configured to receive the enlarged head 194 of the second link rod 182. The rocker lever 138 comprises a first access point 146 at the proximal end 140 and a second access point 148 at the distal end 142 which allows the user to manually control components in the firearm 10, such as through buttons or pads.

The rocker lever 138 pivots on and is mounted to the firearm 10 by a rocker lever mount 150. As shown in FIG. 10, the rocker lever mount 150 has a proximal end 152 and a distal end 154. A first mounting hole 156 is formed adjacent to the proximal end 152, while a second mounting hole 158 is formed adjacent to the distal end 154. The first mounting hole 156 and second mounting hole 158 are arranged to match the standard pivots of the trigger group of a standard lower receiver, and also align with the first mounting hole 114 and the second mounting hole 116 of the stack lever mount 108, respectively. An alignment support surface 160 extends between the first mounting hole 156 and the second mounting hole 158 of the rocker lever mount 150 and assists the rocker lever 138 in maintaining parallel orientation. An elongated pivot point 162 is formed between the proximal end 152 and the distal end 154 of the rocker lever mount 150. The elongated pivot point 162 provides room and flexibility for the rocker lever 138 to shift slightly to maintain proper alignment.

The components on the left side 16 and the right side 18 of the firearm 10 are joined by a first pivot sleeve 164 and a second pivot sleeve 166 which pass through transversely through the lower receiver 26, replacing the standard pivots of the trigger group. The first pivot sleeve 164 extends through and is held in position by the first mounting hole 114 of the stack lever mount 108 and the first mounting hole 156 of the rocker lever mount 150. The second pivot sleeve 166 extends through and is held in position by the second mounting hole 116 of the stack lever mount 108 and the second mounting hole 158 of the rocker lever mount 150. Each of the first pivot sleeve 164 and the second pivot sleeve 166 has a first end 168, 170 which fits through one of the mounting holes 114, 116 of the stack lever mount 108 and a second end 172, 174 which attaches to one of the mounting holes 156, 158 of the rocker lever mount 150. The first end 168, 170 of each pivot sleeve 164, 166 preferably has an enlarged head 176, 178 and may preferably have a surface configured to interface with a tool, such as a screwdriver, for easy installation. The second end 172, 174 of each pivot sleeve 164, 166 is configured, such as being threaded, such that it can be easily fastened to one of the mounting holes 156, 158 of the rocker lever mount 150. In a preferred embodiment, the mounting holes 156, 158 of the rocker lever mount 150 may have corresponding threads to those at the second end 172, 174 of each pivot sleeve 164, 166. Each of the first pivot sleeve 164 and the second pivot sleeve 166 have hollow passages extending therethrough for receiving link rods. The pivot sleeves 164, 166 provide pivot surfaces for the trigger group components.

A first link rod 180 is present in the passage extending through the first pivot sleeve 164. A second link rod 182 is present in the passage extending through the second pivot sleeve 166.

At its proximal end 184, the first link rod 180 has an enlarged head 186 which resides in the cavity 136 adjacent the second protrusion 134 in the bolt catch 126. The enlarged head 186 of the first link rod 180 may preferably include a surface which interacts with a tool, such as a screwdriver, for easy installation. The distal end 188 of the first link rod 180 may preferably be threaded so that it can be secured to a barrel nut 190. The barrel nut 190 fastens the distal end 188 of the first link rod 180 to the rocker lever 138. The barrel nut 190 pivots inside a cavity 141 at the proximal end 140 of the rocker lever 138.

At its proximal end 192, the second link rod 182 has an enlarged head 194 which resides in the cavity 144 of the rocker lever 138. The enlarged head 194 of the second link rod 182 may preferably include a surface which interacts with a tool, such as a screwdriver, for easy installation. The distal end 196 of the second link rod 182 may preferably be threaded so that it can be secured to an actuator such as a button or pad. The button or pad fits inside the walled cavity 124 formed in the stack lever mount 108. When the user exerts a force on the button or pad, the bolt catch 126 is released and no longer blocks the path of the bolt carrier 130.

Referring to FIGS. 11 to 14, the firearm 10 of the present invention preferably comprises a charging handle 200 which is secured to the upper receiver 198 of the firearm 10 and engages the bolt carrier 130. The charging handle 200 comprises a shaft 201 that extends from a front end 202 to a rear end 204. The front end 202 has a bolt hook 216 which grasps a portion of the bolt carrier 130.

The charging handle 200 has a left grip wing 206 and a right grip wing 208 adjacent the rear end 204. When not in use, as in FIG. 12*a*, the left grip wing 206 and the right grip wing 208 are folded inwards and do not protrude out to the left or right of the firearm 10. The left grip wing 206 has a hook feature 207 which engages into a pocket in a standard upper receiver 198 when the left grip wing 206 is folded inwards. In this position, the charging handle 200 does not obstruct the user's view and also is not susceptible to getting caught or damaged on other objects such as the user's clothing.

Figure 12A:
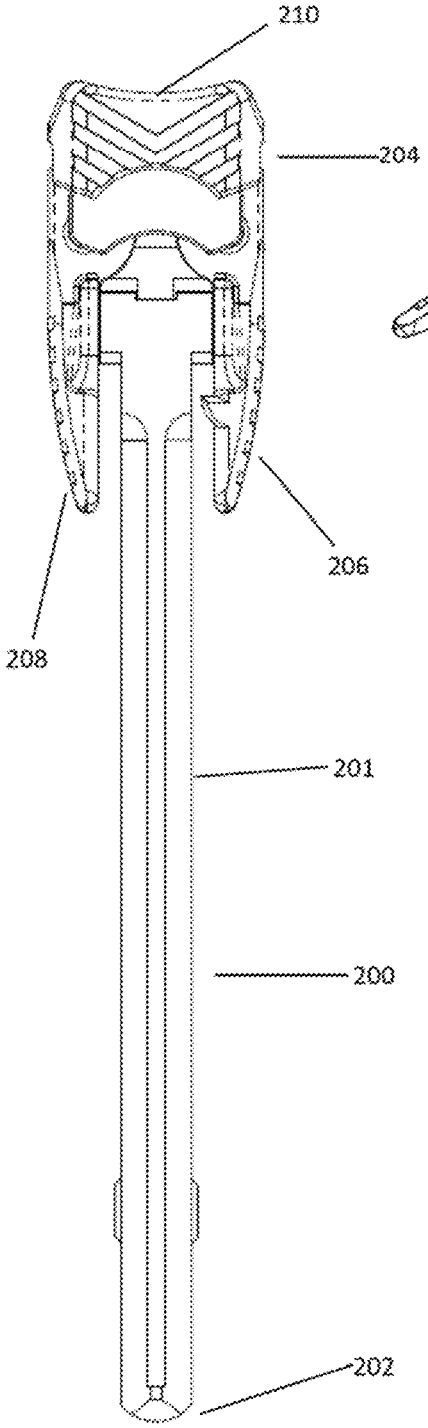
FIGS. 12*a* and 12*b* are top views of a preferred charging handle of the present invention in fully closed and fully open positions, respectively.
Figure 12B:
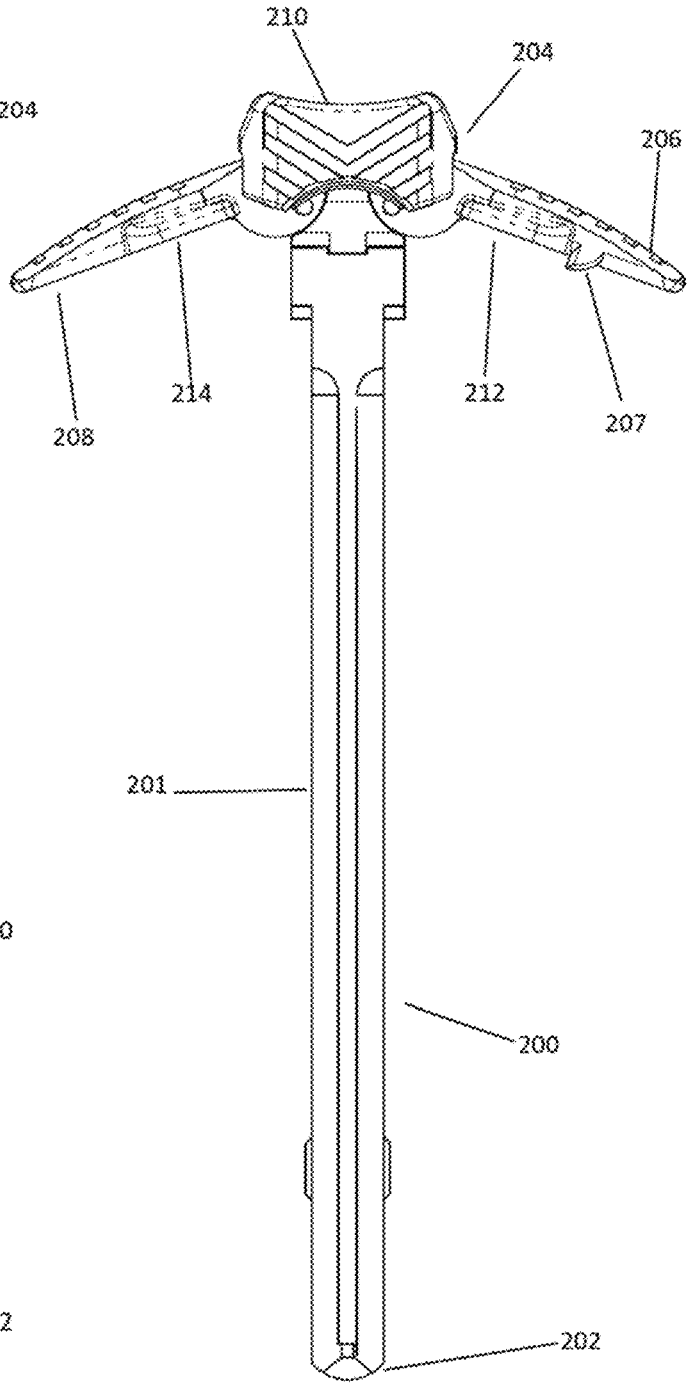
Figures 13A, 13B, 13C, 13D:
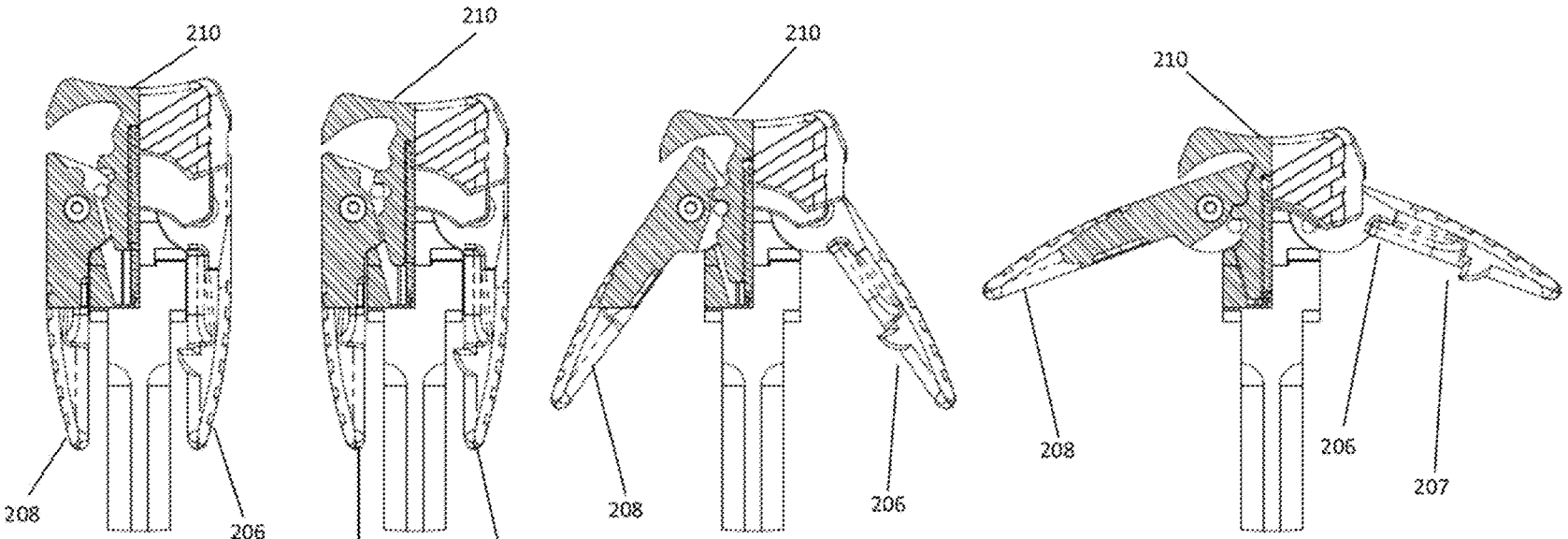
FIGS. 13*a*, 13*b*, 13*c* and 13*d* are partially sectioned top views of the preferred charging handle of the present invention from the fully closed to fully open positions.
Figure 14:
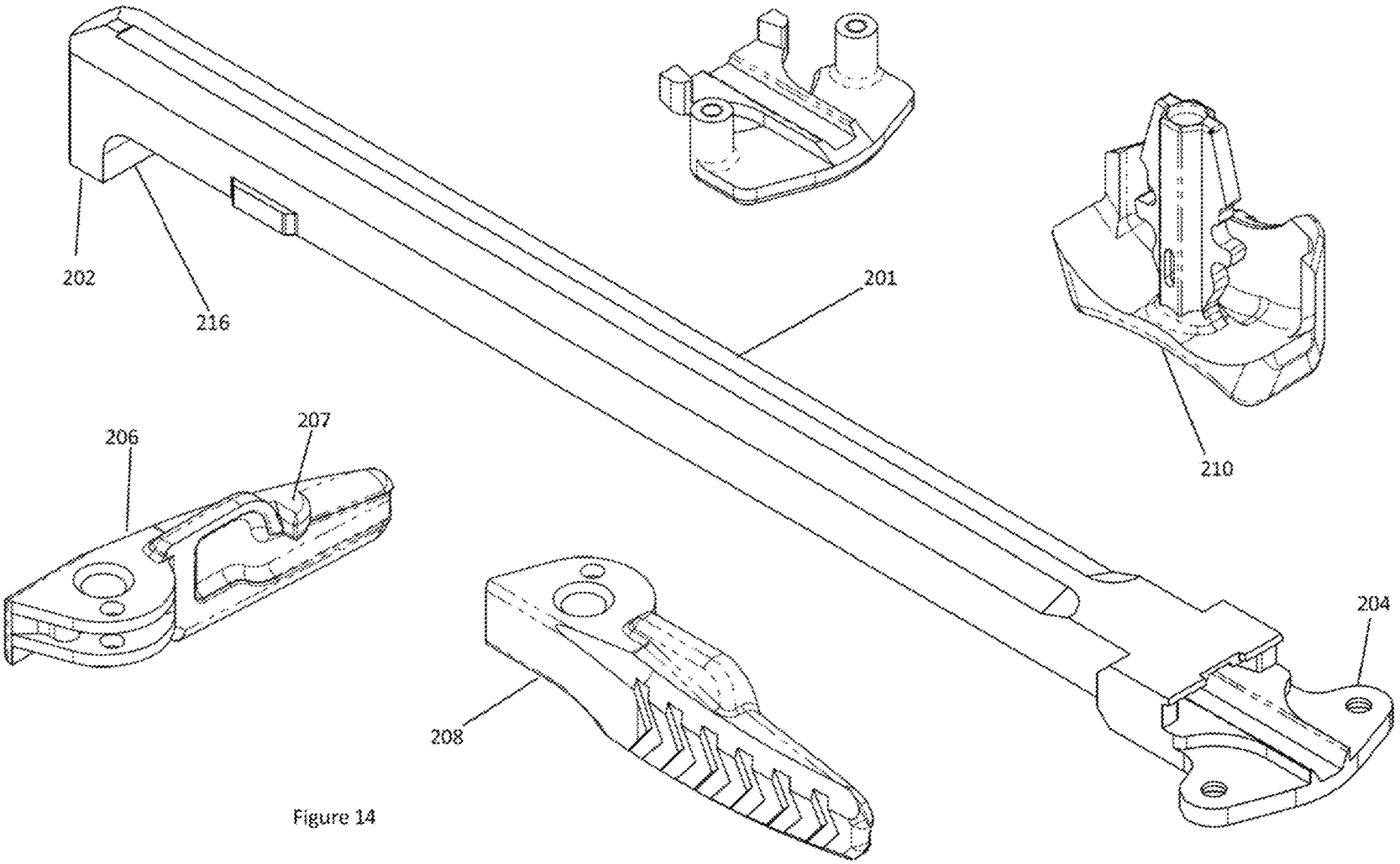
FIG. 14 is a view of the individual components of a preferred charging handle of the present invention.
Figure 15:
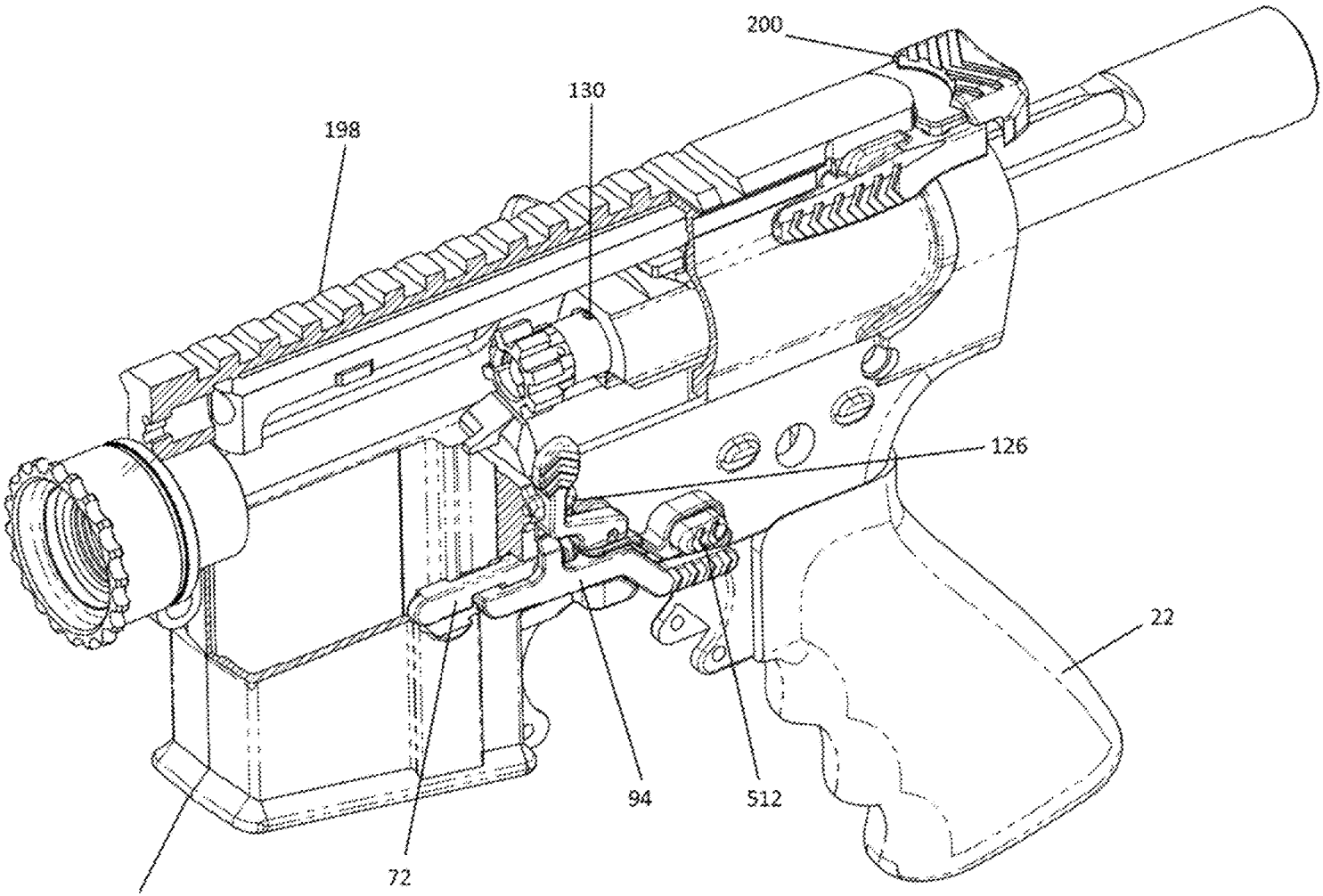
FIG. 15 is a partial section view of a preferred firearm of the present invention showing the bolt carrier held in the rearward position by the raised bolt catch.
Figure 16C:
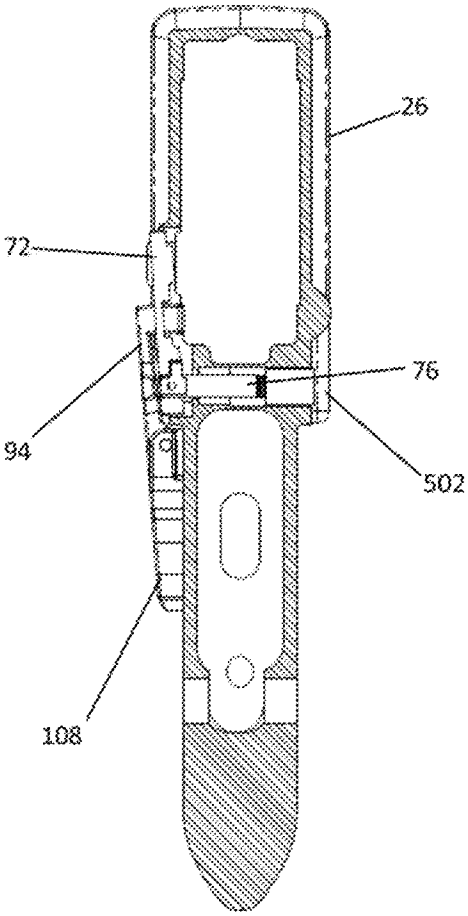
FIGS. 16*a*, 16*b* and 16*c* are section views of the preferred magazine release mechanism, and specifically.
Figure 16B:
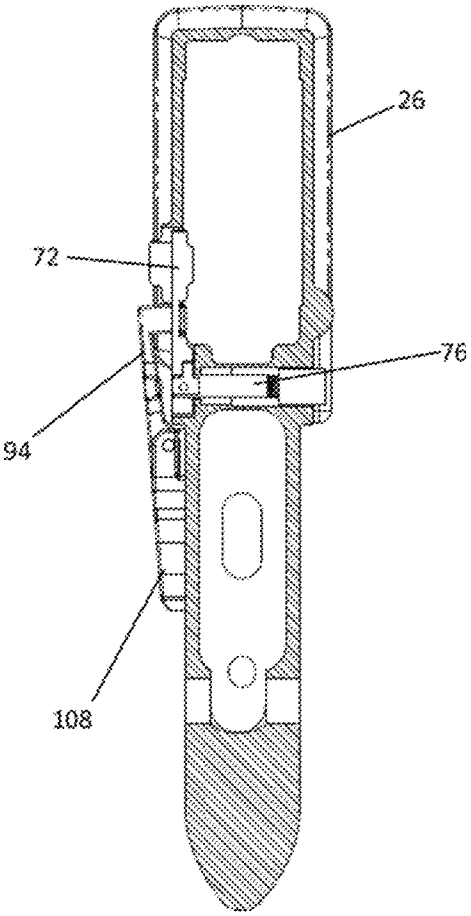
Figure 16A:
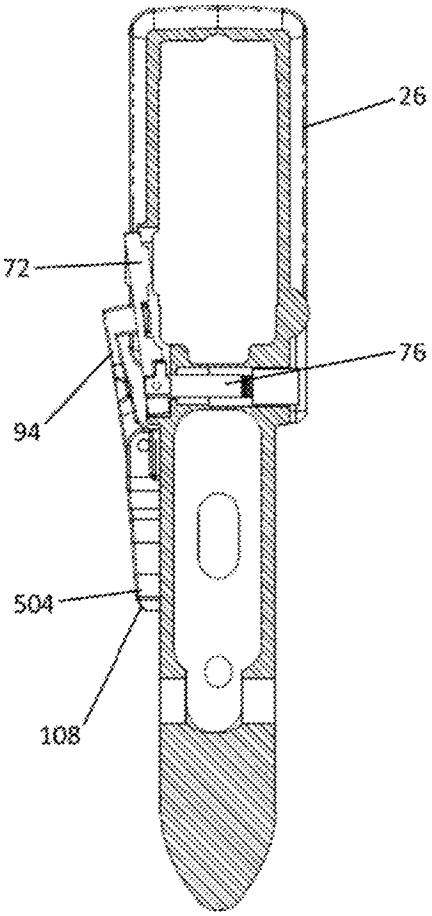

A rear face 210 is provided at the rear end 204. Pushing on the rear face 210 causes the left grip wing 206 and the right grip wing 208 to extend out to the left and right, respectively, as shown in FIG. 12*b*. When extended, the grip wings 206, 208 can be used to grasp the charging handle 200 and pull rearwards. Each grip wing 206, 208 is sufficiently long so that a user can grab it with two or three fingers. The user can pull on just one or both of the grip wings 206, 208 and therefore, can pull using either their left hand or right hand, or both, and can pull on either the left side 16 or right side 18, or both, of the firearm 10. Pulling rearwards on the charging handle 200 causes the bolt carrier 130 to retract.

The grip wings 206, 208 have inner surfaces 212, 214 which are concave in shape. This allows combustion gases from firing a round to be directed forwards and away from the user's face when the wings 206, 208 are folded inwards.

The concave first inner surface 212 of the first grip wing 206 and the concave second inner surface 214 of the second grip wing 208 provide a path for combustion gases to travel in a direction substantially towards the forward end 12 of the firearm 10. This applies when the first grip wing 206 and the second grip wing 208 are folded parallel to the left side 16 and the right side 18 of the firearm 10.

The present invention is designed such that an empty ammunition magazine 28 is automatically ejected from the firearm 10 upon the last cartridge 32 being chambered, and before the last cartridge has been fired. The automatic ejection of the ammunition magazine 28 can save the user critical time that would otherwise need to be spent manually ejecting the empty magazine 28. Furthermore, while loading a new magazine 28, the user is protected by still having a single round chambered and ready to fire. In this way, the user does not necessarily need to re-acquire the target.

Automatic ejection of a spent magazine 28 preferably operates as follows. When the bolt carrier 130 strips the last cartridge 32 from the magazine 28 and places it into the firing chamber, the follower 56 has risen to the top end 38 of the magazine 28. The inwardly curving shoulders 64 of the follower 56 pass in between and above the retention flanges 50 at the top end 38. The protrusion 66 on the follower 56 travels upwards and makes contact with the magazine release catch 72. The magazine release catch 72 pivots as a class 2 lever about the central axis of the magazine release post 76. The follower 56 continues to travel upwards until it contacts the underside of the bolt carrier 130, pushing the magazine 28 out. No longer secured by the magazine release catch 72, the spent magazine 28 is ejected from the lower receiver 26 of the firearm. Once depressed section 54 of the magazine is no longer present for the first protrusion 102 of the stack lever 94 to rest on, the stack lever 94 is spring biased to pivot so that first protrusion 102 moves inward towards the midline of the firearm 10.

The second protrusion 106 of the stack lever 94 is in contact with the first protrusion 132 of the bolt catch 126. When the stack lever 94 pivots, it moves the bolt catch 126 to an engaged position where the face 128 of the bolt catch retains the bolt carrier 130 in the rearward position and prevents it from moving forward. This allows the user to quickly and easily insert a loaded ammunition magazine 28 into the lower receiver 26 to replace the ejected spent magazine 28.

Figures 8A, 8B, 8C:
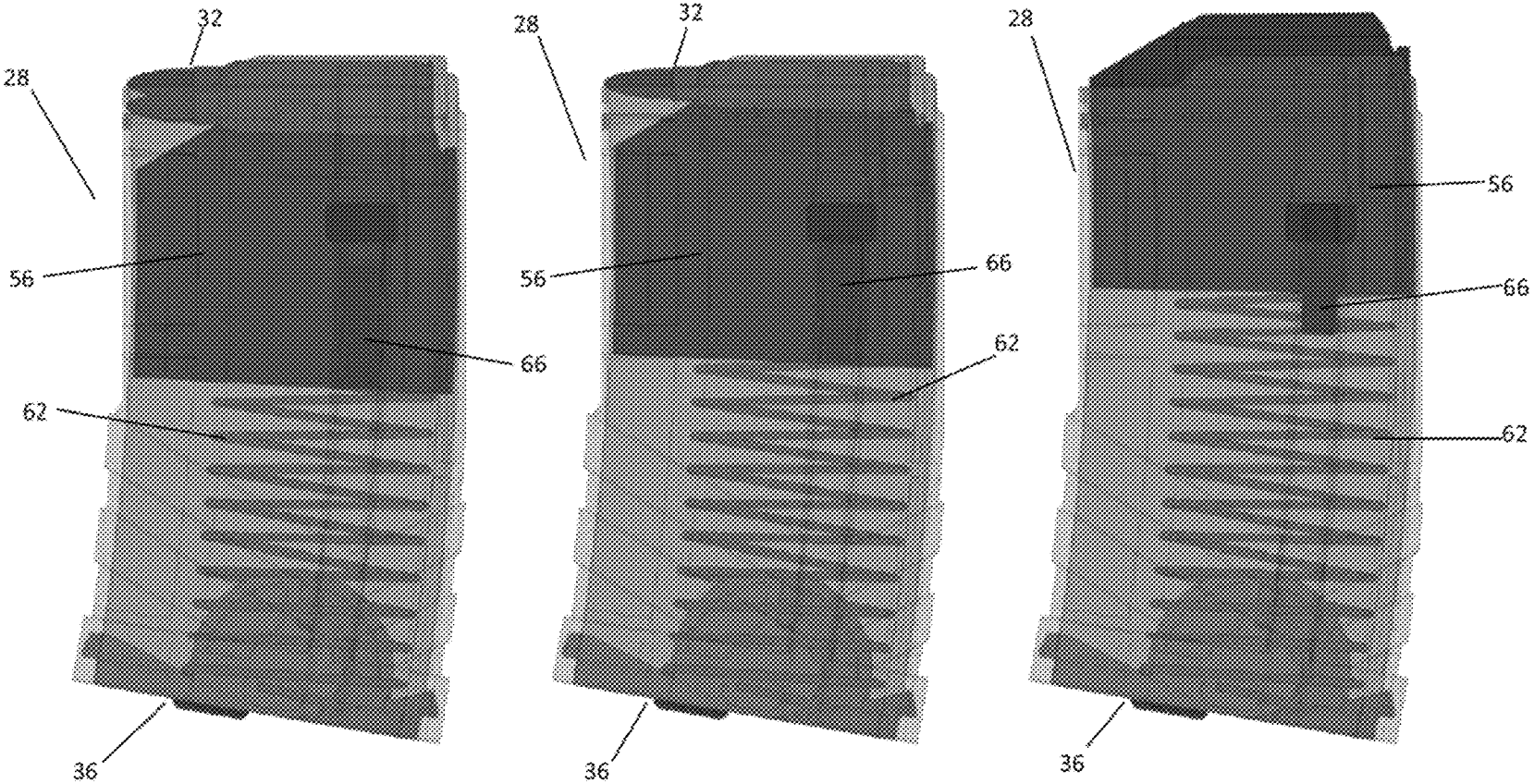
FIGS. 8*a*, 8*b* and 8*c* are elevation views of a preferred ammunition magazine of the present invention while loaded with varying amounts of ammunition.
Figure 9:
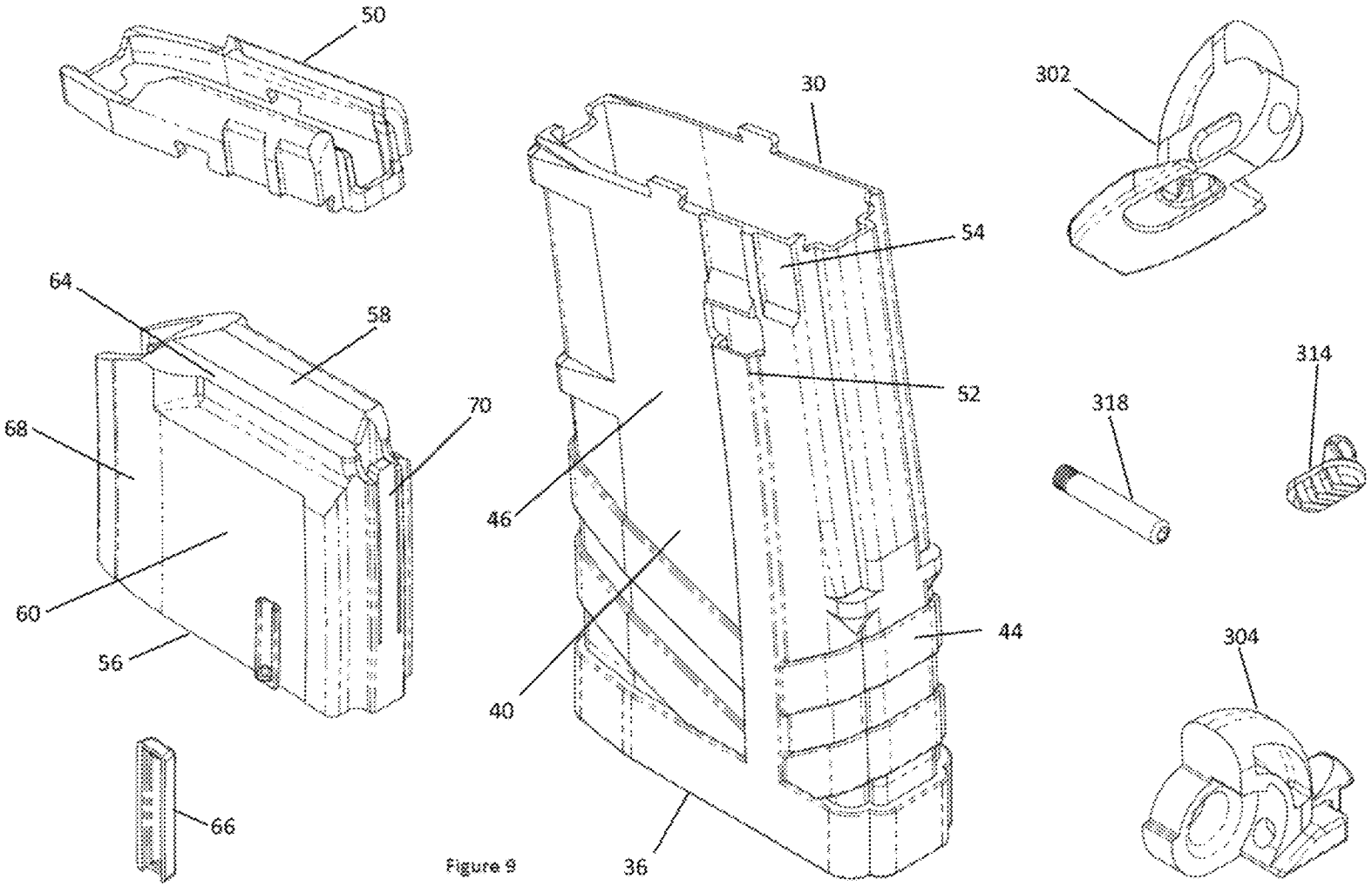
FIG. 9 is an exploded view of the components of a preferred ammunition magazine of the present invention.
Figure 18A:
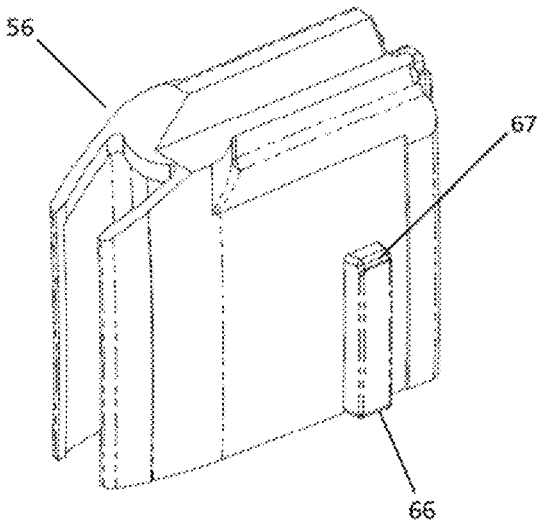
FIGS. 18*a* and 18*b* illustrate the follower and the magazine catch, including their interface features.
Figure 18B:
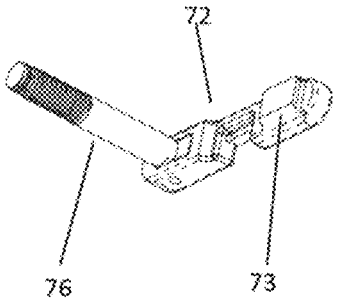

In one preferred embodiment as shown in FIGS. 18*a* and 18*b*, the angled ramp 67 of the protrusion 66 on the follower 56 makes contact with the angled surface 73 on the lower surface of the magazine release catch 72 during the magazine ejection process. The protrusion 66 can therefore effectively wedge the magazine release catch 72 to move it out of the way and pivot. As shown in FIG. 8*b*, the protrusion 66 makes contact as the follower 56 continues to travel upwards due to the bias of the follower spring 62. As shown in FIG. 8*c*, the follower 56 is allowed to move upwards to contact the underside of the bolt carrier 130 for ejection of the magazine 28, while the spring-loaded protrusion 66 stops moving upwards relative to the follower 56 and a part of the protrusion 66 extends below the follower 56. In this manner, while the protrusion 66 fully blocks the magazine catch port, it does not impede the further upward movement of the follower 56 making ejection of the magazine 28 more efficient. The protrusion 66 blocking the magazine catch port is what prevents accidental insertion of an empty magazine and prevents false confidence in an unloaded firearm.

Figure 4B:
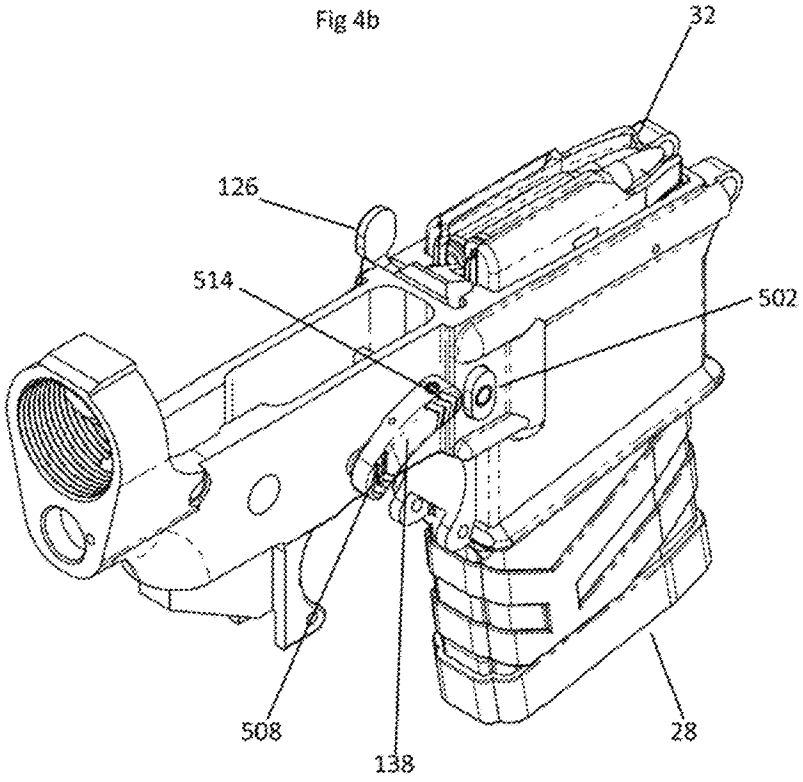
FIGS. 4*a* and 4*b* are left side and right side views of a preferred ammunition magazine and a preferred control group of the present invention applied to a lower receiver of a firearm.
Figure 4A:
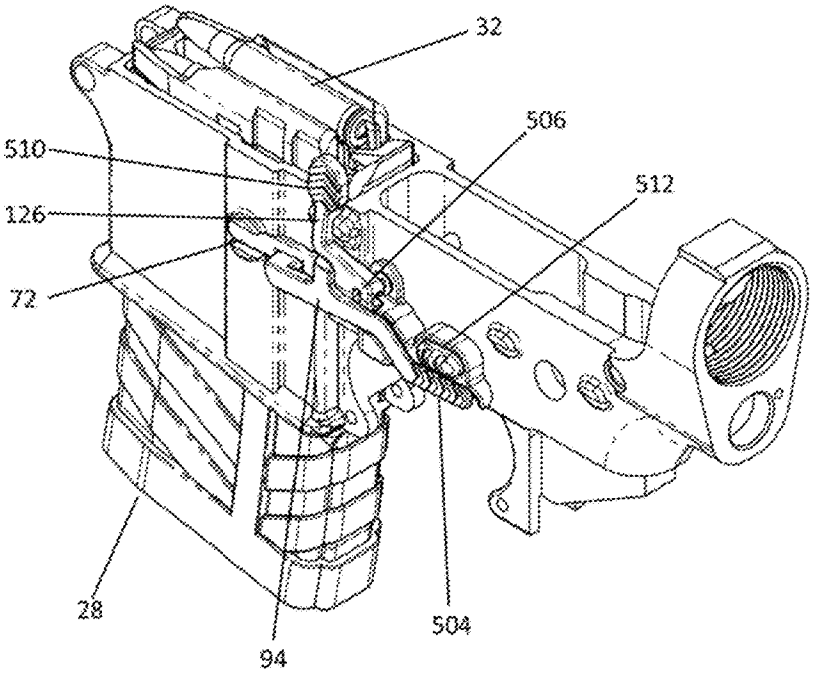
Figures 5, 5A, 5B, 5C:
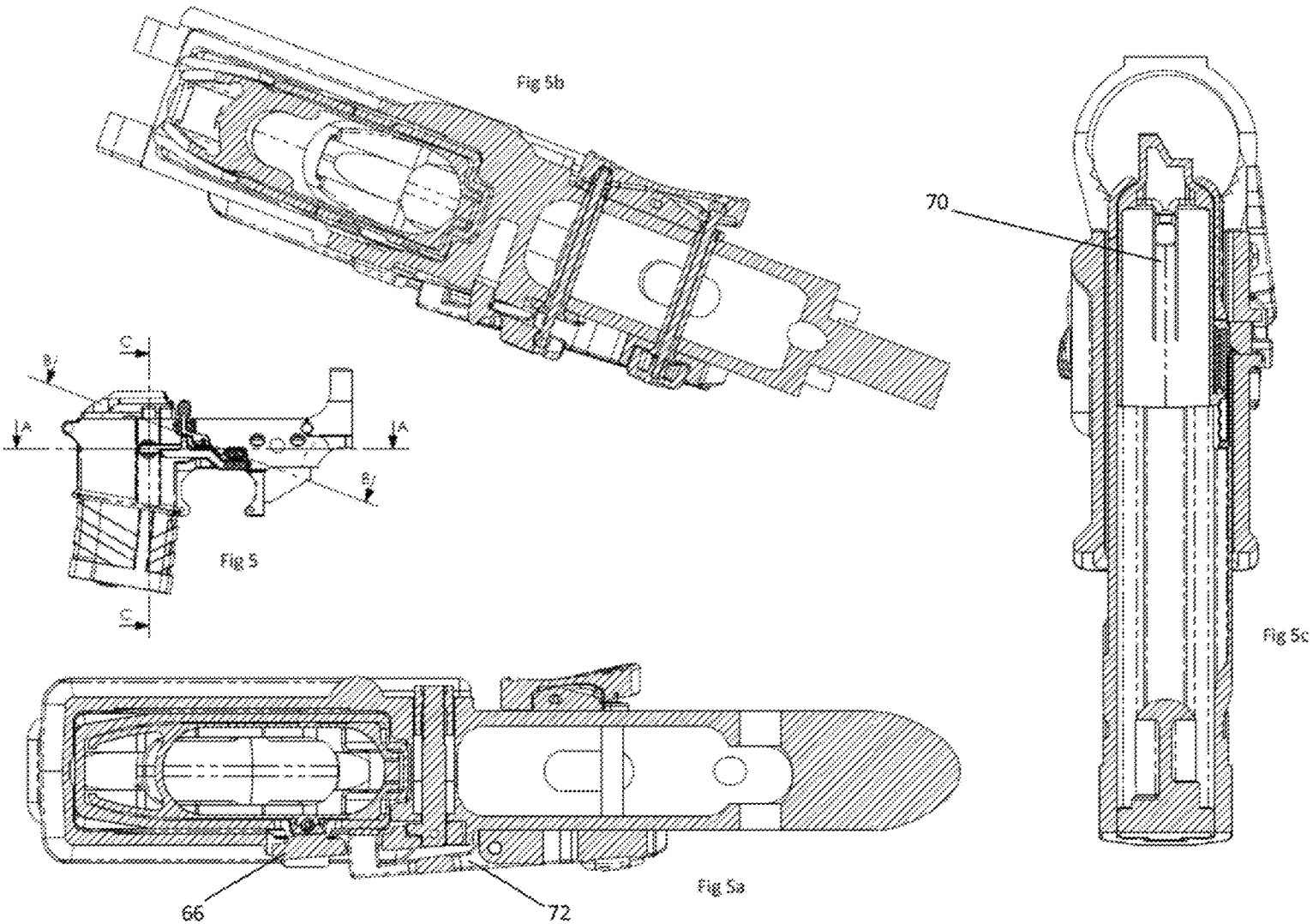
FIGS. 5, 5*a*, 5*b* and 5*c* are cross-sectional views of a preferred ammunition magazine and a preferred control group of the present invention applied to a lower receiver of a firearm along section lines A-A, B-B and C-C.
Figure 6:
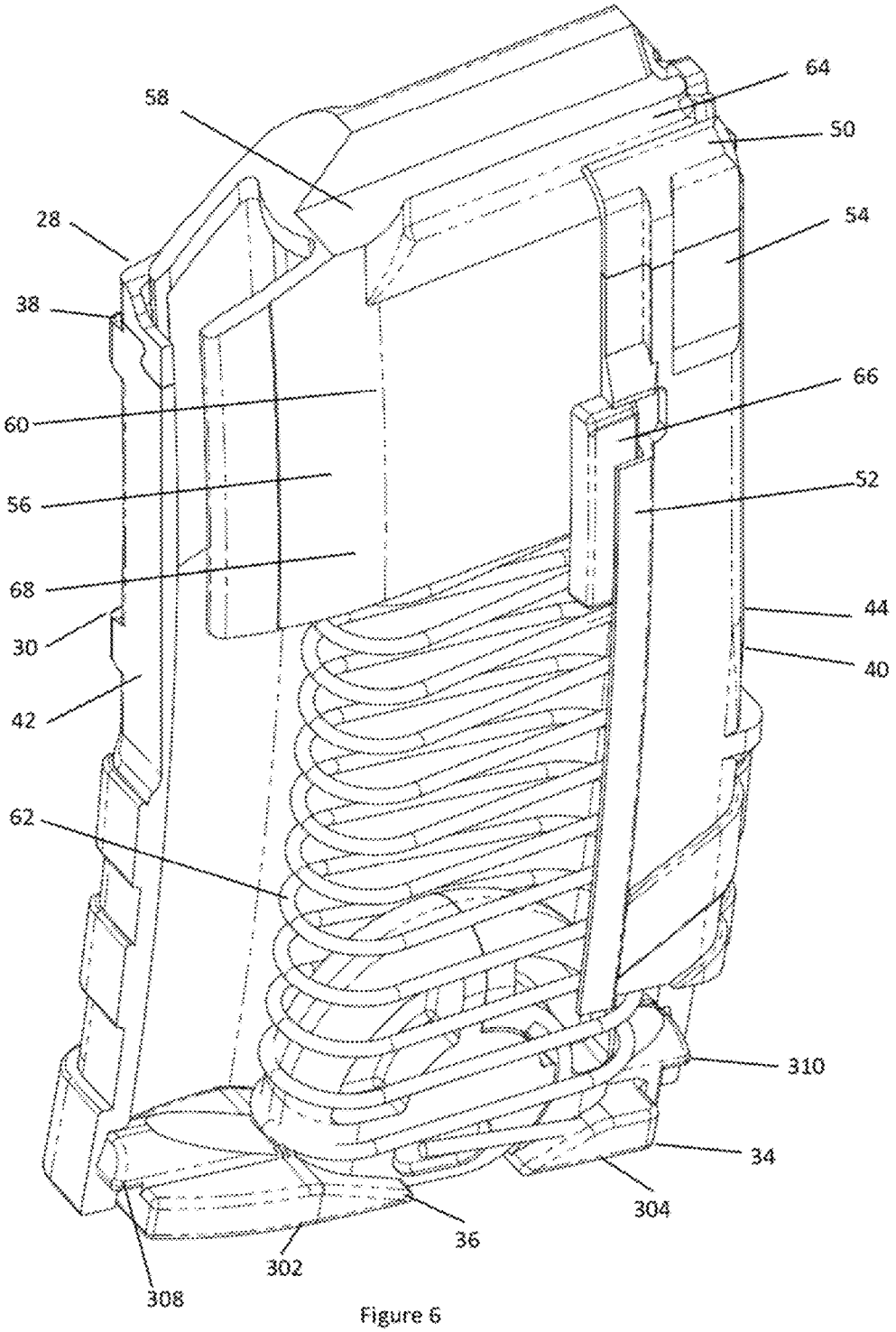
FIG. 6 is a partial section view of a preferred ammunition magazine of the present invention.
Figure 7B:
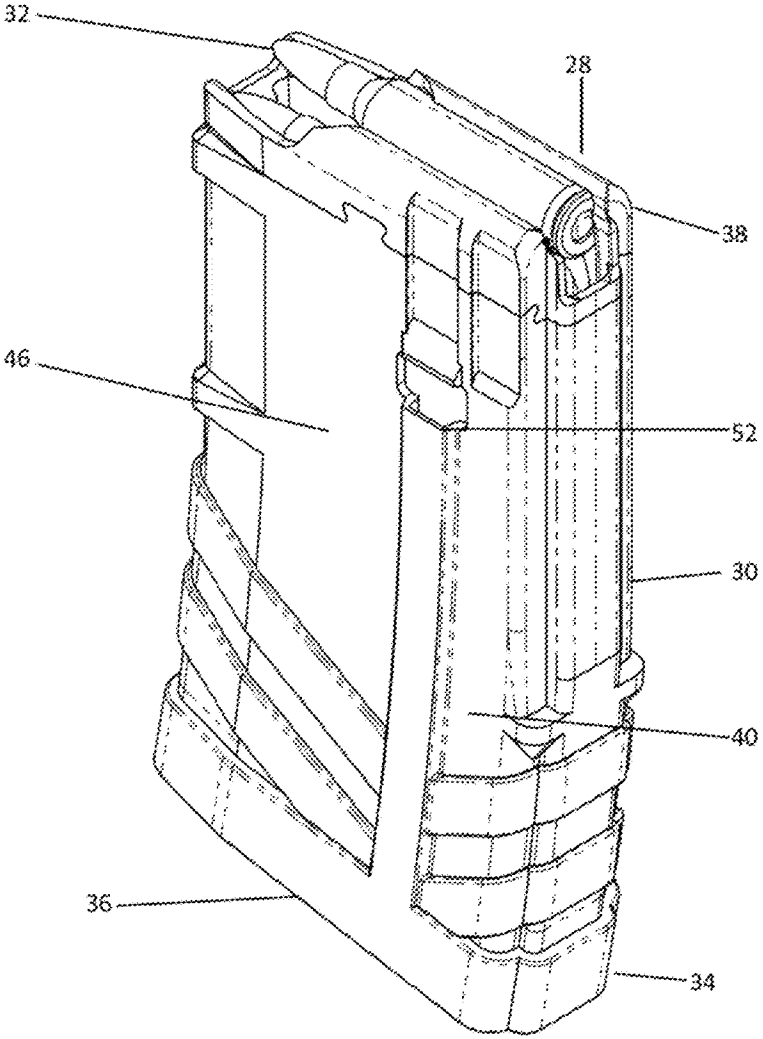
FIGS. 7*a* and 7*b* are right side and left side views of a preferred ammunition magazine of the present invention.
Figure 7A:
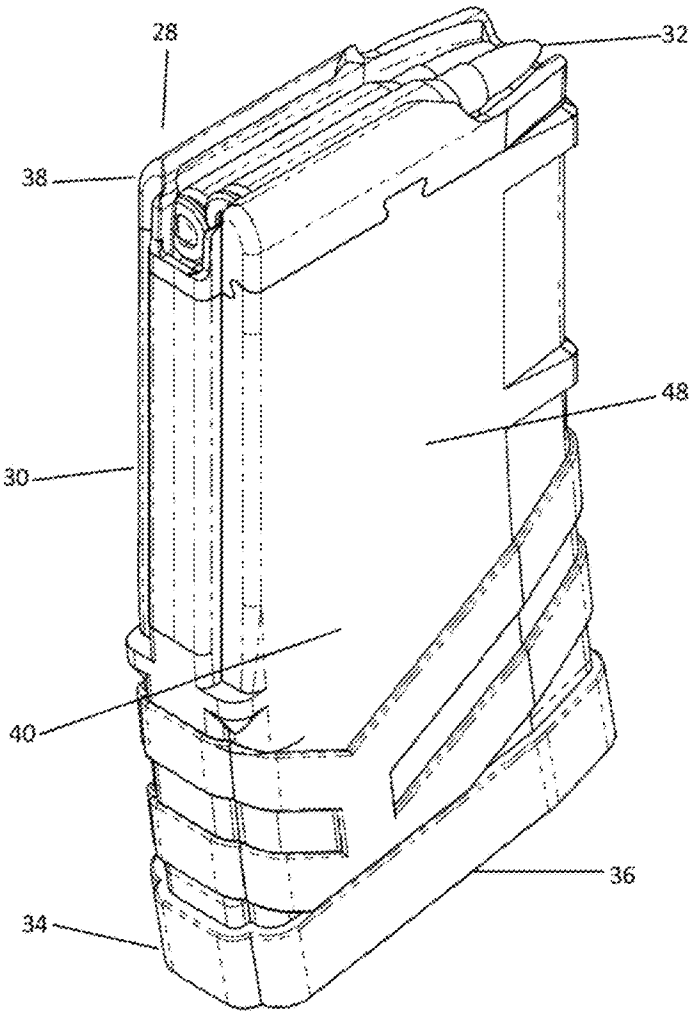

The firearm 10 of the present invention also provides for manual ejection of the ammunition magazine 28 on both the left side 16 and right side 18, as shown in FIGS. 4*a* and 4*b*. As is standard in many firearms, a button or pad 502 is provided on the right side 18 of the firearm 10. When a user pushes this button or pad 502, such as with a force substantially perpendicular to the right side of the firearm, the magazine release catch 72 translates along the central axis of the magazine release post 76 and no longer secures the magazine 28. The magazine 28 is ejected from the lower receiver 26.

In addition, another button or pad 504 is provided on the left side of the firearm 10. When a user pushes this button or pad 504, such as with a force substantially perpendicular to the left side of the firearm, the stack lever 94 pivots such that the first protrusion 102 and hook 104 interact with the notch 90 and ledge 92 of the magazine release catch 72, respectively. The magazine release catch 72 pivots about the central axis of the magazine release post 76 and no longer secures the magazine 28. The magazine 28 is ejected from the lower receiver 26. Therefore, both sides of the firearm are accessible to the user when he or she wishes to manually eject a magazine 28.

The firearm 10 of the present invention also provides for manual engagement of the bolt catch 126 on both the left side 16 and the right side 18. On the left side 16 of the preferred embodiment, a button or pad 506 is provided on the second protrusion 134 on the bolt catch 126. By pressing this button or pad 506, such as with a force substantially perpendicular to the left side of the firearm, a user causes the bolt catch 126 to move into a position whereby its face 128 blocks the bolt carrier 130 from travelling forward.

On the right side 18 of the preferred embodiment, a button or pad 508 is provided on the second access point 148 at the distal end 142 of the rocker lever 138. By pressing button or pad 508, such as with a force substantially perpendicular to the right side of the firearm, the rocker lever 138 pivots on the rocker lever mount and exerts a force on the distal end 188 of the first link rod 180 by means of the barrel nut 190. This force is imparted to the left side 16 through the first link rod 180, directly to the cavity 136 adjacent to the second protrusion 134 of the bolt catch 126. This moves the bolt catch 126 into the engaged position with the face 128 retaining the bolt carrier 130 in the rearward position.

The present invention also provides for the manual release of the bolt catch 126 from either the left side 16 or the right side 18 of the firearm 10. On the left side 16 of the preferred embodiment, as is standard for many firearms, a button or pad 510 is provided on the bolt catch 126 adjacent the face 128. When a user presses on the button or pad 510, such as with a force substantially perpendicular to the left side of the firearm, the bolt catch 126 is released from the engaged position and no longer blocks the bolt carrier 130 from travelling forward.

Another button or pad 512 is provided on the left side 16 of the preferred embodiment. This button or pad 512 fits inside the walled cavity 124 formed in the stack lever mount 108, and when a user presses the button or pad 512, such as with a force substantially perpendicular to the left side of the firearm, a force is exerted on the distal end 196 of the second link rod 182. The force is imparted through the link rods 180, 182 and the rocker lever 138 directly to the cavity 136 adjacent to the second protrusion 134 of the bolt catch 126, which causes the bolt catch 126 to be released and no longer block the path of the bolt carrier 130.

Another button or pad 514 is provided on the right side 18 of the preferred embodiment. This button or pad 514 is provided on the first access point 146 at the proximal end 140 of the rocker lever 138. When a user presses button or pad 514, such as with a force substantially perpendicular to the right side of the firearm, a force is exerted on the barrel nut 190 which fastens the distal end 188 of the first link rod 180. The force is imparted through the first link rod 180 directly to the cavity 136 adjacent to the second protrusion 134 of the bolt catch 126, the bolt catch 126 is moved out of the engaged position and allows the bolt carrier 130 to move forward and strip a cartridge 32 from the ammunition magazine and carry the cartridge 32 into the firing chamber.

The present invention also preferably provides a charging handle 200 for manually pulling the bolt carrier 130 rearwards. When not in use, a spring in the charging handle 200 biases the grip wings 206, 208 to remain in the inward folded state. The left grip wing 206 has a hook which engages a pocket on the standard upper receiver 198 keeping the handle stowed. The left grip wing 206 and right grip wing 208 are folded inwards and extend generally forwards.

When the user pushes on the rear face 210, the grip wings 206, 208 pivot and extend outwards, with the left grip wing 206 extending generally perpendicular to the left of the firearm 10 and the right grip wing 208 extending generally perpendicular to the right of the firearm 10. The user can use either hand, or both hands, to pull on either the left grip wing 206 or the right grip wing 208, or both. Pulling on either of the grip wings 206, 208 moves the charging handle 200 rearwards. Since the bolt hook 216 of the charging handle 200 engages the bolt carrier 130, this causes the bolt carrier 130 to retract as well. Once the firearm 10 is charged and the user returns the charging handle 200 to the forward position, the grip wings 206, 208 are urged back to the folded inward position by the spring in the charging handle 200 causing the hook 207 in the left grip wing 206 to engage the pocket in the upper receiver 198.

The preferred embodiment illustrated in the drawings shows the ammunition magazine 28, the control group and the charging handle 200 applied to an AR-15 rifle. However, it is understood that the present invention, including all of these components, can be applied to a wide variety of firearms. For example, they can be applied to replicas of AR-15 rifles, M16 rifles, replicas of M16 rifles, M4 rifles, replicas of M4 rifles and many others.

The scope of the claims should not be limited by the preferred embodiments set forth in the examples, but should be given the broadest interpretation consistent with the description as a whole.

The invention claimed is:

1. An ammunition magazine for use with a firearm, said firearm comprising a lower receiver and a magazine catch for attaching the ammunition magazine to the lower receiver, said ammunition magazine comprising a container body for carrying ammunition cartridges, said container body having a bottom end defined by a bottom door, a side wall extending upwards from the bottom door an open top end which is attachable to the lower receiver by the magazine catch, said ammunition magazine comprising a follower positioned inside the container body, and a follower spring positioned between the follower and the bottom door, wherein the follower spring provides force to bias the follower and the bottom door so that the follower moves up the side wall as ammunition cartridges are used, wherein said follower further comprises an outwardly extending protrusion, said protrusion making contact with and moving the magazine catch when the last ammunition cartridge has been stripped from the ammunition magazine and the follower has moved up above the open top end of the ammunition magazine, such that the ammunition magazine is detachable from the lower receiver.

2. The ammunition magazine of claim 1, wherein the follower comprises:

(i) a platform, wherein ammunition cartridges rest on said platform; and (ii) a skirt extending generally perpendicularly and downwardly from said platform, wherein said protrusion on said follower extends outwardly from said skirt on the same side as the magazine catch.

3. The ammunition magazine of claim 2, wherein the platform of the follower comprises inwardly and upwardly curving shoulders which allow the platform to move up past one or more obstructions and above the top end of the ammunition magazine.

4. The ammunition magazine of claim 3, wherein an upper surface of the protrusion on the follower is angled and a corresponding lower surface of the magazine catch is angled, wherein said protrusion is moveable up and down relative to the skirt of the follower, and a protrusion spring biases the protrusion to move upwards relative to the skirt of the follower, wherein when said protrusion makes contact with and moves the magazine catch, the angled upper surface of the protrusion wedges up against the angled lower surface of the magazine catch, and the follower continues to move upwards due to the bias of the follower spring while the upward movement of the protrusion stops.

5. The ammunition magazine of claim 1, wherein the bottom door of the magazine comprises a front half section, a rear half section and a hinge located between the front half section and the rear half section and having a folding axis oriented substantially perpendicular to the left side and the right side of the firearm, wherein the bottom door has tabs extending from each half section, said tabs interfacing with cavities in the container body of the magazine when the front half section and the rear half section extend parallel to each other, wherein the bottom door further comprises a sliding lock which disables the hinge when the front half section and the rear half section extend parallel to each other, and wherein the front half section and the rear half section interface with a lower end of the follower spring for retaining the follower spring in place.

* * * * *